US009512498B2

(12) United States Patent
Baba et al.

(10) Patent No.: US 9,512,498 B2
(45) Date of Patent: Dec. 6, 2016

(54) PROCESS FOR PRODUCING SPHEROIDAL-GRAPHITE CAST IRON, AND SPHEROIDAL-GRAPHITE CAST IRON MEMBER OBTAINED FROM SAID SPHEROIDAL-GRAPHITE CAST IRON

(71) Applicant: AKEBONO BRAKE INDUSTRY CO., LTD., Tokyo (JP)

(72) Inventors: Tsukasa Baba, Tokyo (JP); Takao Horiya, Tokyo (JP); Takuya Tokiyama, Tokyo (JP); Takashi Sato, Tokyo (JP); Hiroshi Idei, Tokyo (JP); Yutaka Nishikawa, Tokyo (JP); Masakazu Kitahara, Tokyo (JP); Hidekazu Narita, Tokyo (JP)

(73) Assignee: AKEBONO BRAKE INDUSTRY CO., LTD., Tokyo (JP)

( * ) Notice: Subject to any disclaimer, the term of this patent is extended or adjusted under 35 U.S.C. 154(b) by 357 days.

(21) Appl. No.: 14/364,453

(22) PCT Filed: Dec. 19, 2012

(86) PCT No.: PCT/JP2012/082962

§ 371 (c)(1),
(2) Date: Jun. 11, 2014

(87) PCT Pub. No.: WO2013/094652

PCT Pub. Date: Jun. 27, 2013

(65) Prior Publication Data

US 2014/0348694 A1 Nov. 27, 2014

(30) Foreign Application Priority Data

Dec. 22, 2011 (JP) ..... 2011-282407

(51) Int. Cl.

| | |
|---|---|
| ***C21C 1/10*** | (2006.01) |
| ***B22D 27/20*** | (2006.01) |
| ***C22C 37/04*** | (2006.01) |
| ***C22C 28/00*** | (2006.01) |
| ***C22C 33/08*** | (2006.01) |
| ***C22C 38/00*** | (2006.01) |
| ***C22C 38/02*** | (2006.01) |
| ***C22C 38/06*** | (2006.01) |
| ***C22C 43/00*** | (2006.01) |
| ***B22D 1/00*** | (2006.01) |
| ***C22C 37/10*** | (2006.01) |

(52) U.S. Cl.

CPC . *C21C 1/10* (2013.01); *B22D 1/00* (2013.01); *B22D 27/20* (2013.01); *C21C 1/105* (2013.01); *C22C 28/00* (2013.01); *C22C 33/08* (2013.01); *C22C 37/04* (2013.01); *C22C 37/10* (2013.01); *C22C 38/002* (2013.01); *C22C 38/02* (2013.01); *C22C 38/06* (2013.01); *C22C 43/00* (2013.01)

(58) Field of Classification Search

CPC ..... C22C 33/08

See application file for complete search history.

(56) References Cited

U.S. PATENT DOCUMENTS

2001/0024622 A1* 9/2001 Van Eldijk ..... C21C 1/10 420/22

2007/0134149 A1 6/2007 Koike et al.

FOREIGN PATENT DOCUMENTS

| | | |
|---|---|---|
| EP | 2 468 903 A1 | 6/2012 |
| ES | 2 362 241 | 6/2011 |

(Continued)

*Primary Examiner* — Jessee Roe

*Assistant Examiner* — Christopher Kessler

(74) *Attorney, Agent, or Firm* — Drinker Biddle & Reath LLP

(57) ABSTRACT

A process for producing spheroidal graphite cast iron includes a spheroidization treatment, an inoculant treatment and a pouring inoculation treatment. A molten iron is subjected to the spheroidization treatment using a spheroidizing agent of an Fe—Si—Mg—Ca-based alloy which contains a given amount of Ba and contains substantially no rare-earth element.

2 Claims, 16 Drawing Sheets

(56) References Cited

FOREIGN PATENT DOCUMENTS

| | | | |
|---|---|---|---|
| JP | S59-43844 | A | 3/1984 |
| JP | S61-223166 | A | 10/1986 |
| JP | H06-279917 | A | 10/1994 |
| JP | H08-188812 | A | 7/1996 |
| JP | H08-333650 | A | 12/1996 |
| JP | H09-125125 | A | 5/1997 |
| JP | H10-237528 | A | 9/1998 |
| JP | H10-317093 | A | 12/1998 |
| JP | 2000-303113 | A | 10/2000 |
| JP | 2004-339577 | A | 12/2004 |
| JP | 2007-182620 | A | 7/2007 |

* cited by examiner

A: FRACTURE SURFACE OF CHILL TEST SPECIMEN

PROCESS FOR PRODUCING SPHEROIDAL-GRAPHITE CAST IRON, AND SPHEROIDAL-GRAPHITE CAST IRON MEMBER OBTAINED FROM SAID SPHEROIDAL-GRAPHITE CAST IRON

TECHNICAL FIELD

The present invention relates to a process for producing spheroidal graphite cast iron and a spheroidal graphite cast iron member which uses the spheroidal graphite cast iron, such as, in particular, a vehicle component that has a thin-wall part.

BACKGROUND ART

Spheroidal graphite cast iron is in wide use as components for vehicles including motor vehicles, machine parts, etc., because the spheroidal graphite cast iron has excellent tensile strength and ductility. In particular, this spheroidal graphite cast iron is used in brake calipers, which are important as safety components for vehicles such as motor vehicles, in order to ensure the quality thereof.

Since there recently is a desire for weight reduction and size reduction in these components, the spheroidal graphite cast iron members to be used are also required to be reduced in thickness. In the case where a spheroidal graphite cast iron member is produced so as to be reduced in thickness, a cooling rate is increased in the thin-wall part thereof and this results in the formation of a chill phase (abnormal structure). Since this chill phase has an exceedingly hard structure, the machinability of the spheroidal graphite cast iron member is undesirably reduced.

Because of this, spheroidal graphite cast iron members having a thin-wall part, in particular, components for motor vehicles, are frequently required to be inhibited from having a chill structure and to retain a high level of balance between tensile strength and ductility. Consequently, when a spheroidal graphite cast iron member is produced, the cast molten iron is subjected to a spheroidization treatment and further subjected to an inoculation treatment multiple times. In the spheroidization treatment, a spheroidizing agent containing a rare-earth element (rare earth) is generally used in order to more reliably conduct spheroidization and graphitization.

For example, Patent Documents 1 to 4 disclose spheroidizing agents containing rare earth in a given amount (in the range of about 0.5 to 9% by mass) and spheroidal graphite cast iron produced using the spheroidizing agents. Rare earth not only has the effect of accelerating spheroidization graphitization on the basis of both a deoxidizing and desulfurizing function and the function of lowering the action of spheroidization-inhibitory elements but also serves, for example, to accelerate graphitization, prevent chill phase formation, inhibit chunky graphite formation, and inhibit fading, on the basis of the effect of yielding graphite nuclei, etc. Hence, rare earth is element exceedingly profitable for spheroidal graphite cast iron. Especially in the production of spheroidal graphite cast iron for use in components for motor vehicles, use of a spheroidizing agent containing such rare earth is regarded as essential for preventing chill phase formation in the thin-wall part.

PRIOR-ART DOCUMENTS

Patent Documents

Patent Document 1: JP-A-10-237528
Patent Document 2: JP-A-2000-303113

Patent Document 3: JP-A-2007-182620
Patent Document 4: JP-A-9-125125
Patent Document 5: JP-A-6-279917
Patent Document 6: JP-A-10-317093
Patent Document 7: JP-A-2004-339577

SUMMARY OF THE INVENTION

Problem that the Invention is to Solve

However, rare earth localizes in limited regions on earth, and the prices and production amounts thereof frequently fluctuate considerably depending on the circumstances of producing countries or manufacturers. Especially in recent years, rare earth has become indispensable resources not only in the field of cast metals but also in the fields of electronic appliances, magnets, etc., and the prices thereof are skyrocketing. Consequently, the supply thereof is also unstable.

Therefore, it is strongly desired to establish a process for producing a spheroidal graphite cast iron member using a spheroidizing agent containing no rare earth and to stably supply spheroidal graphite cast iron members at low cost, in order to avoid such supply troubles or steep rises in price.

The present invention has been achieved in view of such current circumstances. An object thereof is to provide a process for producing spheroidal graphite cast iron which is excellent in terms of tensile strength/ductility balance, rigidity, machinability, vibration-damping property, casting property, and profitability and has neither a chill phase nor internal defects, even in the case where a spheroidizing agent containing no rare earth is used, and which is applicable to components of a wider range of product shapes, and to provide a spheroidal graphite cast iron member which uses the spheroidal graphite cast iron.

Means for Solving the Problem

Namely, the present invention relates to the following (1) and (2).

(1) A process for producing spheroidal graphite cast iron which contains substantially no rare-earth element, the process comprising:

(a) a step of adding a spheroidizing agent of an Fe—Si—Mg—Ca-based alloy that contains, in terms of % by mass, 3.0 to 6.0% of Mg, 1.0 to 2.0% of Ca, 0.5 to 3.5% of Ba, and 0.3% or less of Al and that contains substantially no rare-earth element to a molten iron in an amount of 0.8 to 2.0%, in terms of % by mass based on the molten iron, to conduct a spheroidization treatment of the molten iron in a ladle;

(b) a step of conducting an inoculation treatment using a first Fe—Si—Ca-based inoculant or Ca—Si-based inoculant, either simultaneously with the step (a) or after the step (a); and (c) a step of adding a second Fe—Si—Ca-based inoculant containing, in terms of % by mass, 45 to 75% of Si and 1.0 to 3.0% of Ca to the molten iron after the step (b) and before the molten iron is cast into a casting mold, in an amount of 0.2 to 0.4% in terms of % by mass based on the molten iron which has not undergone the spheroidization treatment, to conduct a pouring inoculation treatment, wherein the spheroidal graphite cast iron to be obtained has a composition which contains, in terms of % by mass, 3.0 to 4.5% of C, 3.0 to 4.0% of Si, 0.2 to 0.4% of Mn, 0.006 to 0.020% of S, 0.08 to 0.30% of Cu, 0.020 to 0.040% of Sn, 0.015 to 0.050% of Mg, 0.03% or less of Al, and 0.01% or less of Zn, with the remainder being Fe and unavoidable impurities.

(2) A spheroidal graphite cast iron member comprising spheroidal graphite cast iron obtained by the production process according to (1), the spheroidal graphite cast iron member having a degree of graphite spheroidization of 85% or higher, a tensile strength of 450 MPa or higher, an elongation of 15% or higher, a Young's modulus of 170 GPa or higher, and a logarithmic decrement of $1.0\times10^{-3}$ or higher, wherein a chill area rate is 1% or less in a thin-wall part in which the spheroidal graphite cast iron member comprising the spheroidal graphite cast iron has a thickness of 6 mm or less, wherein, in a macroscopic inspection of a cross-section of the thin-wall part, the cross-section has none of a shrinkage cavity, a pin-hole and a void, each having a diameter or major-axis length of 1 mm or larger.

Effects of the Invention

The spheroidal graphite cast iron according to the present invention has been rendered equal or superior to the conventional spheroidal graphite cast iron in tensile strength, ductility, rigidity, vibration-damping property, and machinability, by adding a given amount of Ba not to the pouring inoculant or secondary inoculant but to the spheroidizing agent during the production of the spheroidal graphite cast iron, although the spheroidizing agent contains no rare earth. Furthermore, the spheroidal graphite cast iron member including the spheroidal graphite cast iron can be deemed to have no internal defects therein even when it is evaluated under severer conditions as compared with conventional ones.

Consequently, the member including the cast iron according to the present invention can be suitably used in the production of small vehicle components having a thin-wall part, in particular, brake calipers, which are safety components important for the safety of vehicles.

Furthermore, according to the present invention, it is possible to stably supply spheroidal graphite cast iron members at low cost without using any material which is expensive and unable to be stably supplied, such as rare earth, as a material for the production thereof. Therefore, it can be extensively applied to products (members) using spheroidal graphite cast iron which are always required to be stably supplied, such as not only those vehicle components but also other vehicle components and machine parts for general industrial applications. The present invention is of great industrial significance.

BRIEF DESCRIPTION OF THE DRAWINGS

FIG. 2 (*a*) is a diagrammatic view illustrating a mold for the wedge-shaped chill test specimen; and FIG. 2 (*b*) is a diagrammatic slant view of a fracture surface of the wedge-shaped chill test specimen.

MODES FOR CARRYING OUT THE INVENTION

Figure 1:
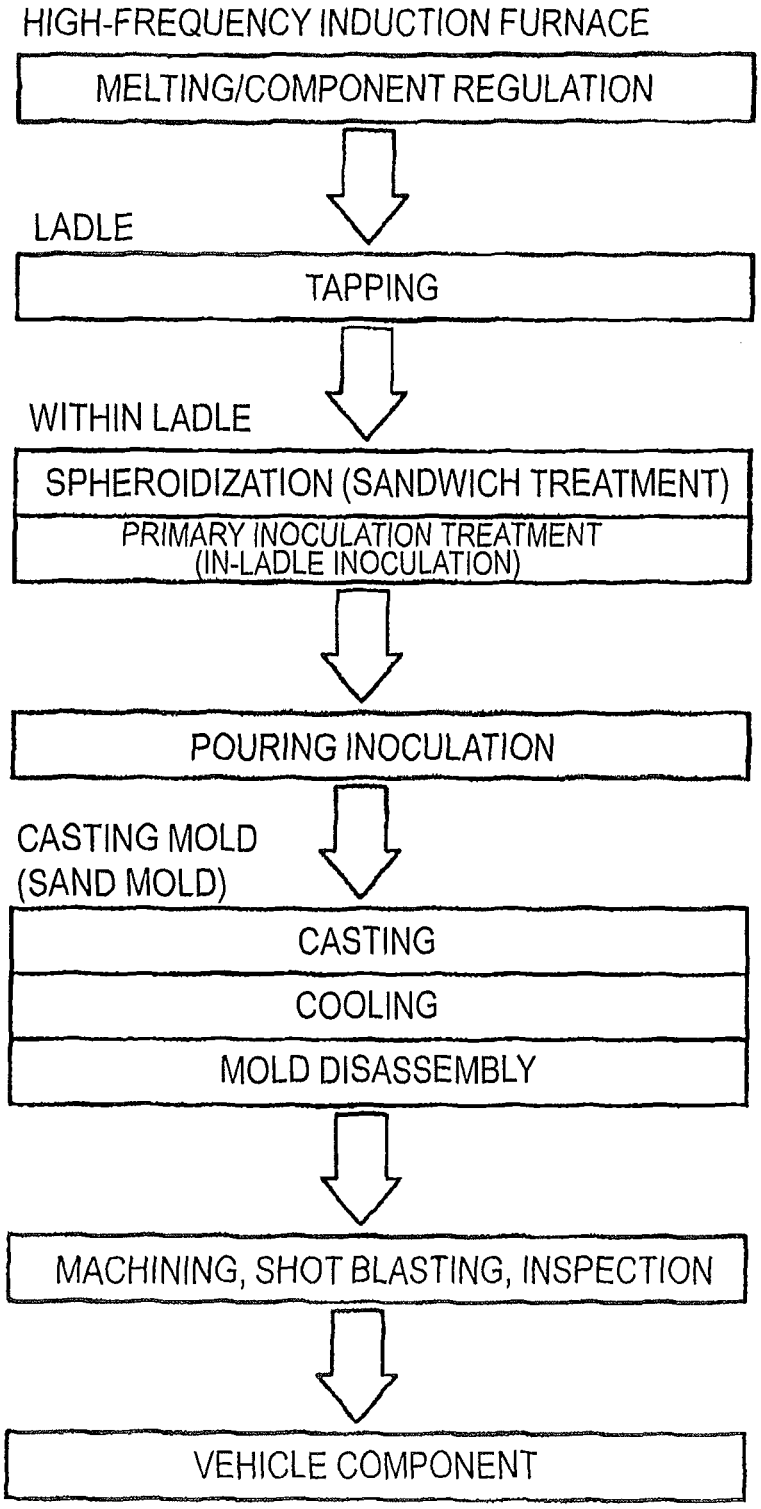
FIG. 1 is a diagrammatic flowchart which shows steps beginning with melting of raw materials and ending with completion of a component for vehicles.

The present invention is explained below in detail. Here, "% by weight" has the same meaning as "% by mass", and the mere expression "%" means "% by weight".

In general, in the case where the content of rare earth in a spheroidizing agent has been reduced or the rare earth has been eliminated from the spheroidizing agent, examples of problems concerning the properties of a product include the following.

(1) A decrease in the degree of graphite spheroidization (hereinafter referred to as "degree of spheroidization") and resultant decreases in tensile strength, ductility, and rigidity, (2) formation of a chill phase (abnormal structure) and a decrease in machinability due to the increase in the tendency to chill phase formation, (3) increased fading (decrease in the period to fading initiation), and (4) an increase in the formation of internal defects such as shrinkage cavities.

Here, the fading is a phenomenon in which an element that was added for the purpose of spheroidization treatment or inoculation treatment is consumed by oxidation or by reaction with other elements with the lapse of time and is diminished thereby and the spheroidization or inoculation does not proceed with the lapse of time.

The present inventors have made detailed and systematic investigations on influences of the components of a molten iron, the components of a spheroidizing agent and inoculant, and the addition amounts thereof and, as a result, they have found that a vehicle component which, even in an as-cast state, is excellent in terms of tensile strength/ductility balance, rigidity, machinability, and casting property can be produced to overcome the above problems (1) to (4) without using any expensive additive element, by simultaneously and accurately controlling the melt components, the amounts of the components of a spheroidizing agent and inoculant, and the addition amounts thereof. The present inventors have thus developed a process for producing spheroidal graphite cast iron having those properties on a high level and suitable for use in vehicle components required to have high quality, such as brake calipers for vehicles.

However, with respect to (4) the increase in the formation of internal defects such as shrinkage cavities, which is one of the technical problems encountered in the case of using a spheroidizing agent containing no rare earth, insufficient points still remain when further future requests for complication, size reduction, and thickness reduction in vehicle components are taken into account. It is hence necessary to provide a process for producing as-cast spheroidal graphite cast iron which can be more reliably applied to a wider range of products and to provide a spheroidal graphite cast iron member including the spheroidal graphite cast iron.

In this description, the term "thin-wall" means that the thickness is 6 mm or less.

In order to meet such requests, the present inventors have repeatedly made various investigations on methods for sufficiently inhibiting the formation of internal defects, in particular, shrinkage cavities, in products, using a spheroidizing agent containing no rare earth. In general, examples of countermeasures for inhibiting the formation of shrinkage cavities in spheroidal graphite cast iron include (a) to reduce the amount of solidification shrinkage (acceleration of graphitization), (b) to enhance the riser effect, and (c) to improve the casting mold strength.

However, the enhancement of the riser effect (b) leads to a decrease in yield of the molten iron due to the increase in riser volume, and a change in the material of the casting mold for the above (c) not only results in an increase in cost but also necessitates considerable reconsideration of the production conditions.

The present inventors hence regarded profitability as important, and directed attention to the reduction of the amount of solidification shrinkage (a) and diligently and repeatedly made investigations. As a result, the present inventors have found that the tendency to formation of the shrinkage cavity can be considerably lessened by adding a given amount of Ba to a spheroidizing agent and accurately regulating the contents of Mg, Ca, and Al in the spheroidizing agent. The present invention has been thus completed.

The investigations are described below in detail.

Ba generally forms oxides or sulfides in a molten iron, and these serve as graphite nuclei to accelerate graphite formation reaction during solidification. Ba is hence regarded as effective in increasing the number of graphite grains and reducing the diameter of graphite grains.

Actually, Ba has hitherto been added to inoculants mainly for spheroidal graphite cast iron to bring about the effect of increasing the number of graphite grains and reducing the diameter of graphite grains, and has been in use as an ingredient for enhancing inoculation effect based on such an effect.

For example, Patent Document 5 discloses that Ba is added to an inoculant in an amount of 10% or less in order to reduce graphite size and accelerate graphitization. Patent Document 6 discloses that Ba is added to a molten iron in an amount of 0.0015 to 0.02% during inoculation or after the inoculation in order to increase the number of graphite grains and reduce the diameter of graphite grains, thereby improving the rigidity of a product. Patent Document 7 discloses that any one or more elements selected from Ca, Sr, and Ba are added in a total amount of 0.5 to 6.0% to an inoculant containing 90 to 99% of Si in order to accelerate graphitization.

As described above, in general methods for Ba addition which have been used hitherto, Ba is not added to a spheroidizing agent but is added to a pouring inoculant or a secondary inoculant.

There is a case (Patent Document 4) in which a spheroidizing agent containing no rare earth is used when a large-size large-thick spheroidal graphite cast iron member is produced. It is, however, known that in the case where Ba is added to the spheroidizing agent containing no rare earth, Ba shows poor solubility in the molten iron to cause a large amount of slag formation, thereby impairing properties such as tensile strength and elongation.

Even in the case where Ba is added to a pouring inoculant or secondary inoculant for the purposes of acceleration of graphitization and size reduction of graphite, there is a problem in that the addition thereof in an amount suitable for those effects enhances acceleration of graphitization and size reduction of graphite but impairs each of the properties concerning tensile strength, tendency to chill phase formation, degree of spheroidization, and fading time.

The present inventors have directed attention to the reduction of the amount of solidification shrinkage due to the graphitization-accelerating effect of Ba, and have repeatedly made various investigations in the expectation that the reduction might bring about the effect of lessening the tendency to shrinkage cavity formation. As a result, the present inventors have found that, even in the case of a spheroidizing agent containing no rare earth, the graphitization is accelerated and uniform and fine graphite is formed, and remarkable effect of inhibiting shrinkage cavity formation in products is achieved, by adding a given amount of Ba thereto.

The present inventors have further found that the increase in slag formation amount due to Ba addition, which has hitherto been regarded as problematic, can be sufficiently diminished by accurately regulating the contents of Mg, Ca, and Al in the spheroidizing agent, and that the formation of inclusions can be significantly suppressed by controlling the content of Al, among those components, so as to be equal to or less than a given value. The present invention has been thus completed.

As apparent from the fact that the addition of Ba to a pouring inoculant or secondary inoculant results in deteriorations in each of properties other than acceleration of graphitization and size reduction of graphite, a modification of the components of a spheroidizing agent or of the components of an inoculant leads to a change in microstructure and resultant changes in various properties. There frequently are cases where the modification deteriorates properties other than those which are desired to be improved. Consequently, in the case of products required to retain a satisfactory balance among many properties, such as components for vehicles, it is necessary to determine the proportion of each component after changes of properties due to addition of a component or change in component content have been sufficiently grasped.

Consequently, in also the present invention, small test specimens were used to conduct the following preliminary test in order to grasp the influences on the other properties besides inhibition of the formation of internal defects by the addition of Ba to a spheroidizing agent and by changes in the content of Mg, Ca and Al, etc.

[Preliminary Test]

First, the same scrap iron as in a mass-production line was melted using a compact high-frequency induction furnace to prepare a molten iron corresponding to the standard FCD400-450 (JIS G 5502) under conditions according to the actual line, and a graphitization spheroidization treatment by a sandwich method was conducted in a ladle. The amount of the spheroidizing agent to be introduced for the graphitization spheroidization treatment and the contents of Mg, Ca, Ba, and Al in the spheroidizing agent were changed. In this operation, a primary inoculation treatment with a commercial Fe—Si—Ca-based inoculant was simultaneously conducted in the ladle.

Specifically, an Fe—Si-based covering material was placed on the spheroidizing agent and the Fe—Si—Ca-based inoculant which were disposed in the pocket at the bottom of the ladle, in the same manner as in actual apparatus, to completely cover the spheroidizing agent and the inoculant, thereby performing these treatments. Furthermore, pouring inoculation in which an inoculant was added to the molten iron was manually conducted just before the molten iron was cast into a casting mold (shell mold). Basic steps were conducted in accordance with the flowchart shown in FIG. 1.

Figure 2:
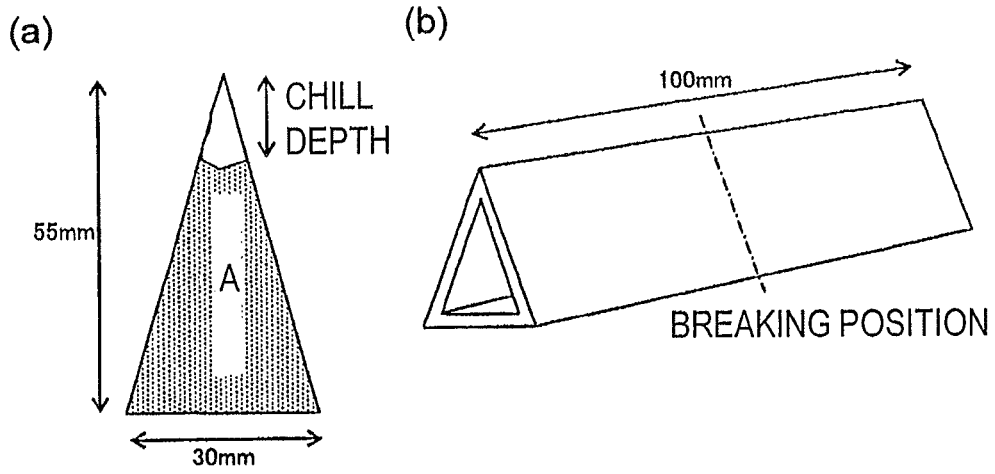
FIG. 2 (*a*) and FIG. 2 (*b*) are views which illustrate a wedge-shaped chill test specimen used in a preliminary test according to the present invention.
Figure 3:
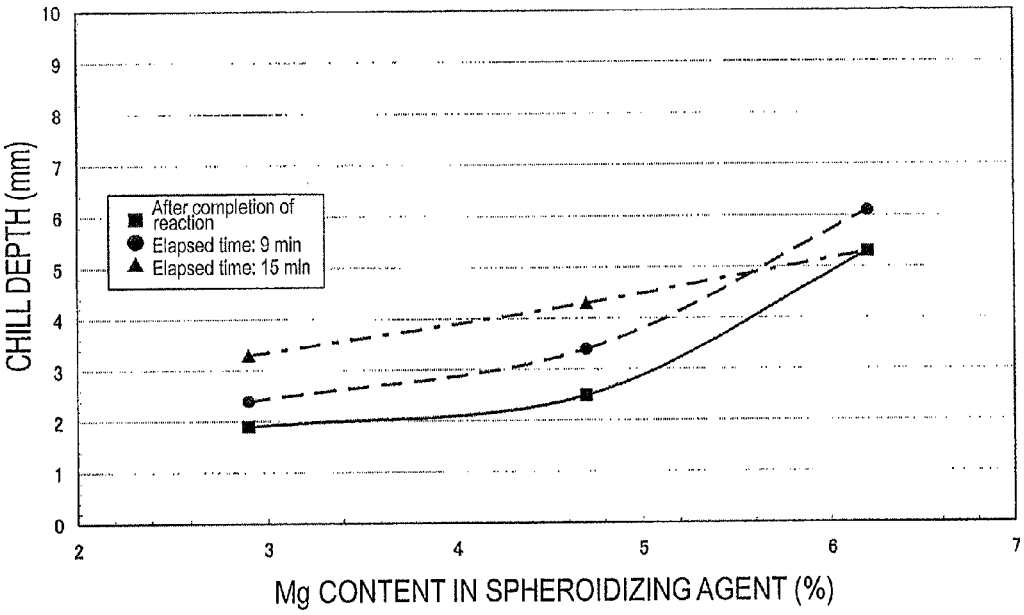
FIG. 3 is a figure which shows a relationship between the content of Mg in a spheroidizing agent and chill depth.
Figure 4:
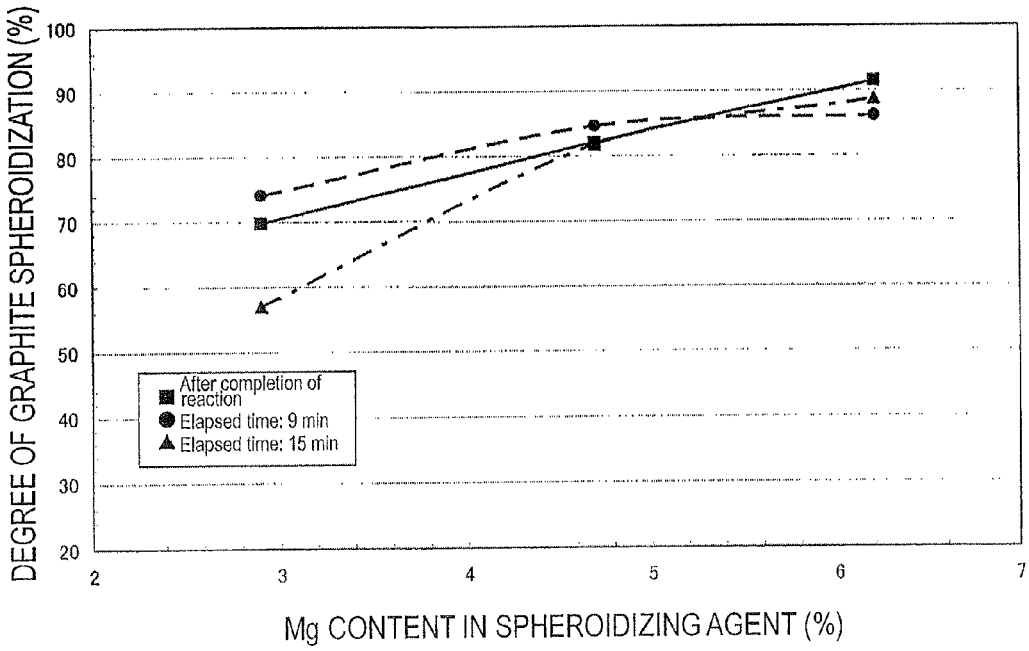
FIG. 4 is a figure which shows a relationship between the content of Mg in a spheroidizing agent and the degree of spheroidization.
Figure 5:
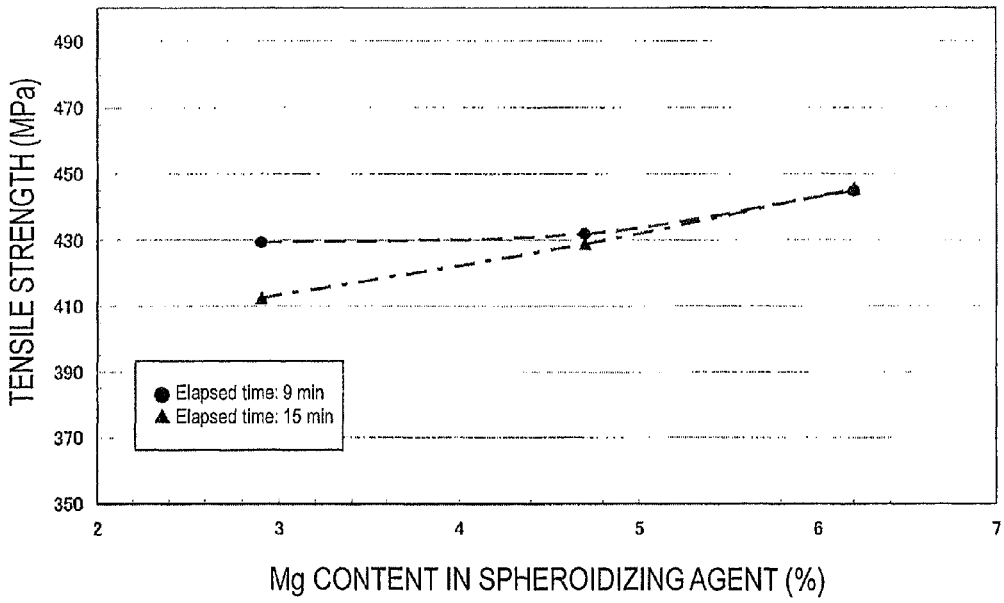
FIG. 5 is a figure which shows a relationship between the content of Mg in a spheroidizing agent and tensile strength.

In this preliminary test, two kinds of casting molds, i.e., a wedge-shaped chill test specimen and a knock-off (Kb) type test specimen (diameter, 25 mm), were used to produce cast iron. The internal dimensions of the wedge-shaped test specimen are as shown in FIG. 2 (*a*). These casting molds were used to produce test specimens while changing the period from spheroidization treatment to casting, in the range of from immediately after the treatment to 15 minutes at the most, in order to evaluate the effect of fading during mass production. The test specimens were examined for various properties.

Each wedge-shaped test specimen was broken at ordinary temperature to obtain a chill test specimen, and the depth of the area which ranged from the tip of the fracture surface and the part in which a chill phase was present (chill depth) was measured with a digital scope (see FIG. 2 (*a*) and FIG. 2 (*b*)). The smaller the chill depth was, the more the tendency to form chill phase formation was inhibited. The degree of spheroidization, the number of graphite grains, etc. were determined by cutting an end (diameter, 25 mm) of the round knock-off (Kb) type rod specimen and examining a central part thereof with an optical microscope. Tensile strength was determined by examining two JIS No. 4 test specimens or the like cut out of each round rod having a diameter of 25 mm.

The results of the preliminary test are described below in detail while referring to drawings.

[Influences of Contents of Mg, Ca, Ba, and Al in Spheroidizing Agent]

Figure 6:
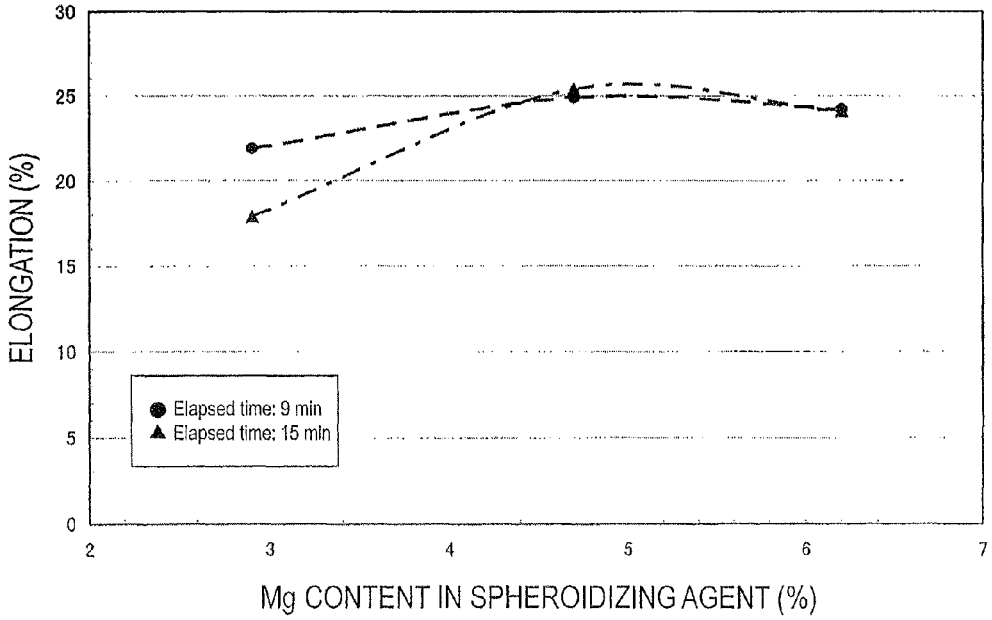
FIG. 6 is a figure which shows a relationship between the content of Mg in a spheroidizing agent and elongation.
Figure 7:
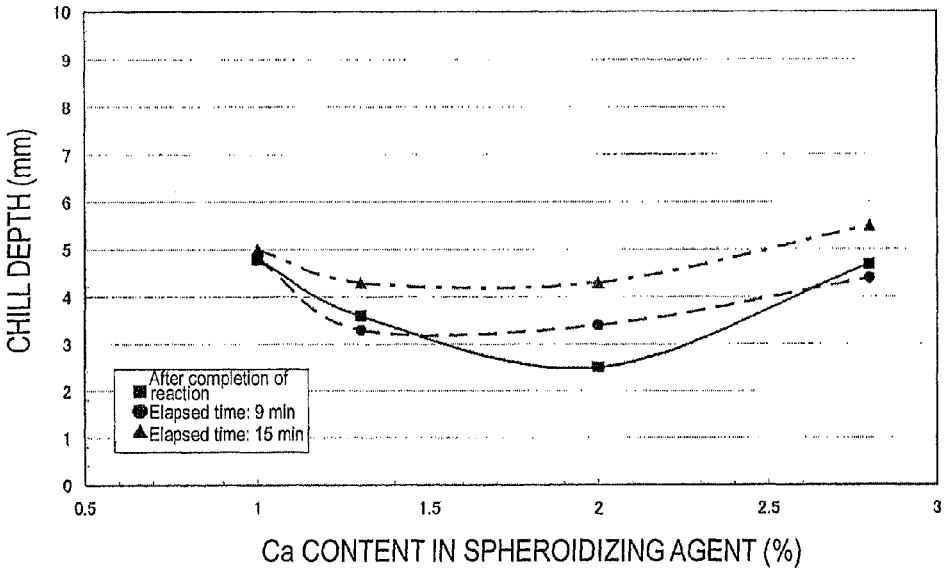
FIG. 7 is a figure which shows a relationship between the content of Ca in a spheroidizing agent and chill depth.
Figure 8:
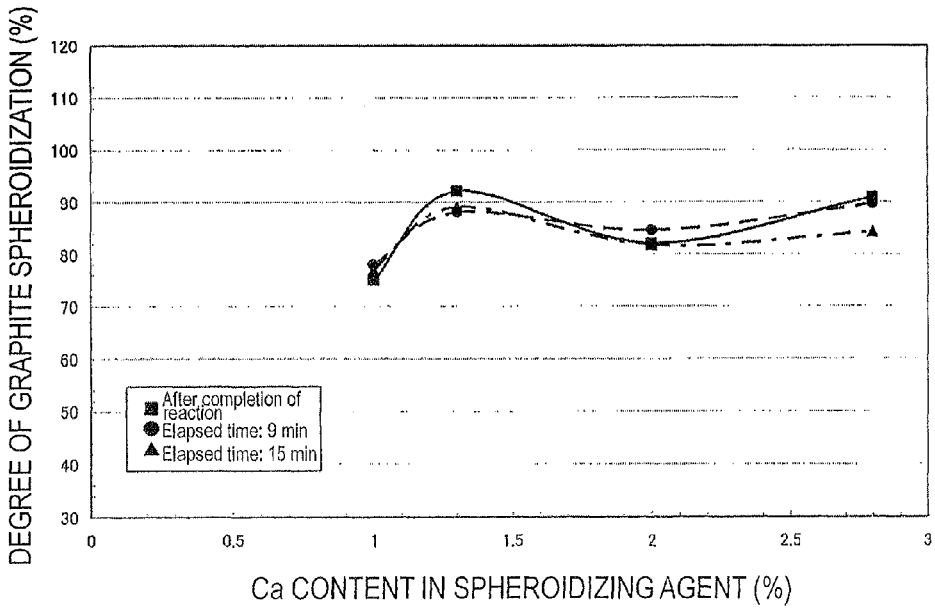
FIG. 8 is a figure which shows a relationship between the content of Ca in a spheroidizing agent and the degree of spheroidization.
Figure 9:
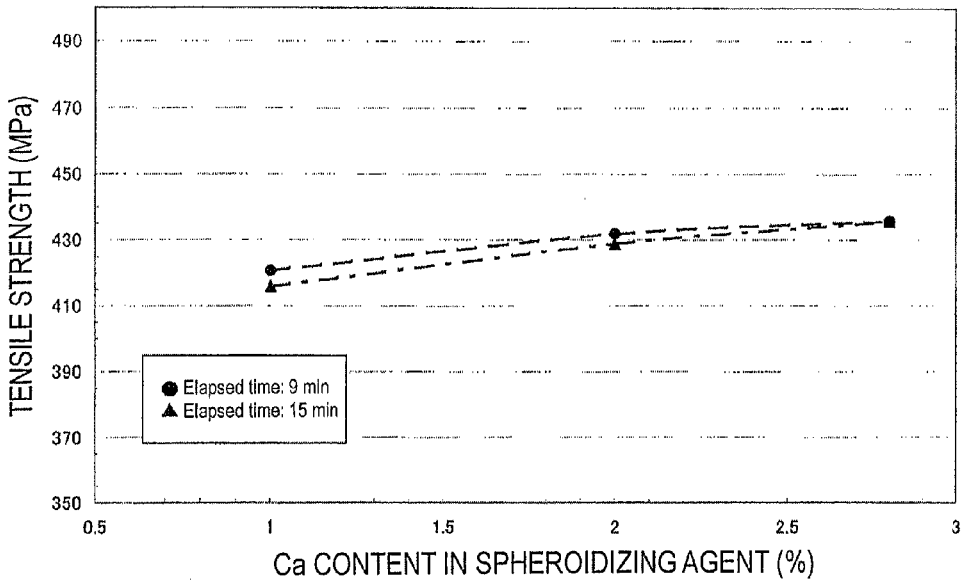
FIG. 9 is a figure which shows a relationship between the content of Ca in a spheroidizing agent and tensile strength.

FIGS. 3 to 6 respectively show relationships between the content of Mg, which is a basic component in a spheroidizing agent, and chill depth (FIG. 3), the degree of spheroidization (FIG. 4), tensile strength (FIG. 5), and elongation (FIG. 6). The differences in each property which were observed when the elapsed time from the spheroidization treatment to the casting was changed, i.e., from just after the treatment (after completion of the reaction) to 9 minutes and to 15 minutes, are also shown.

From the results of the preliminary test, it was confirmed that the inclusion of Mg in the spheroidizing agent is remarkably effective in improving the degree of spheroidization and tensile strength, but it was also confirmed that Mg is an element which enhances the tendency to chill phase formation. It is therefore necessary that a proper range of the content of Mg should be determined while comprehensively assessing influences thereof on various properties.

Figure 10:
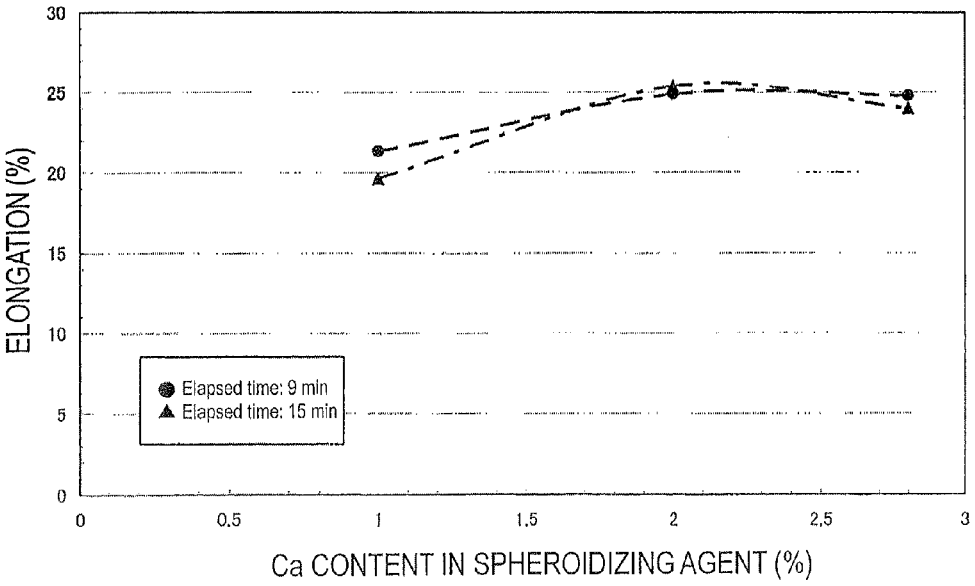
FIG. 10 is a figure which shows a relationship between the content of Ca in a spheroidizing agent and elongation.
Figure 11:
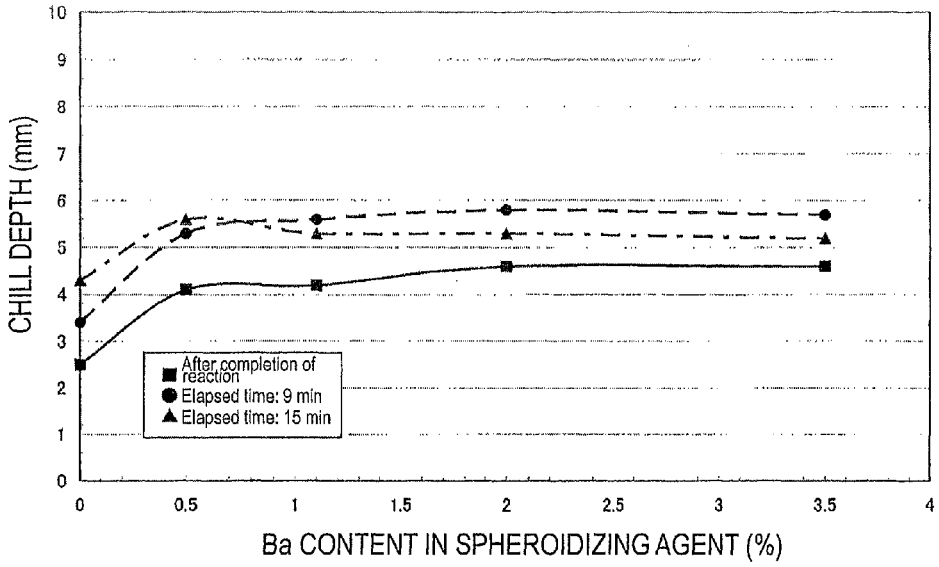
FIG. 11 is a figure which shows a relationship between the content of Ba in a spheroidizing agent and chill depth.
Figure 12:
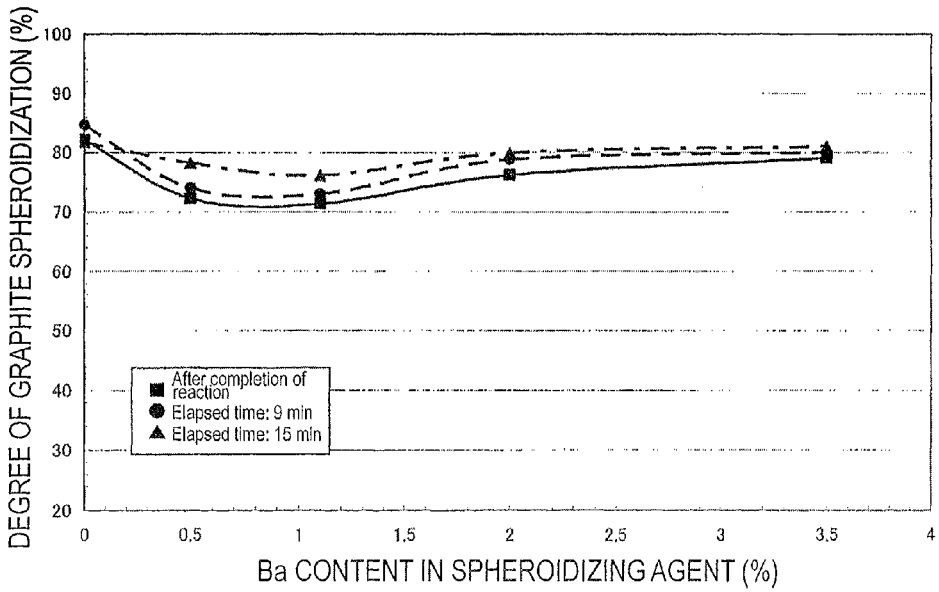
FIG. 12 is a figure which shows a relationship between the content of Ba in a spheroidizing agent and the degree of spheroidization.
Figure 13:
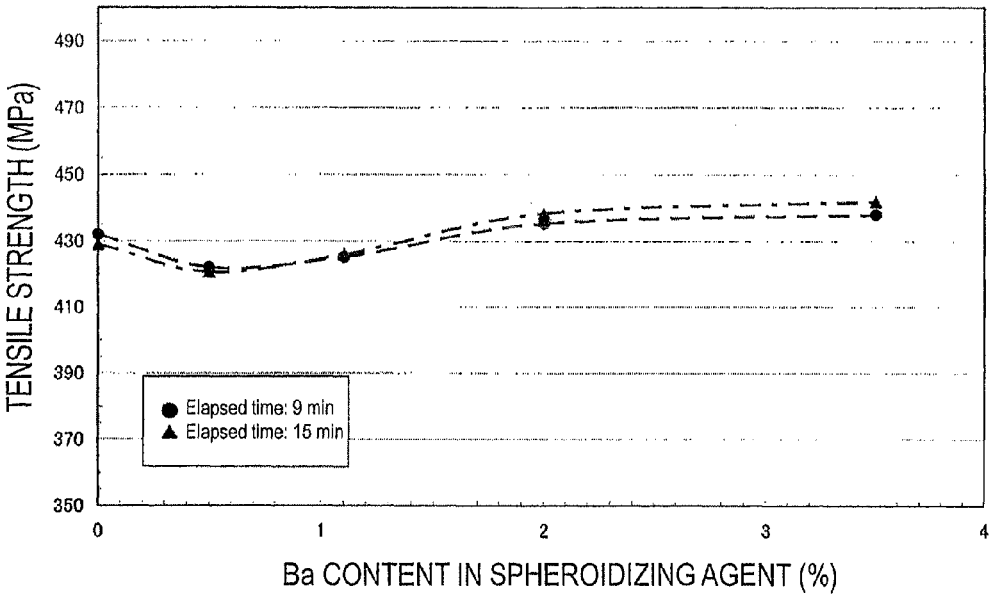
FIG. 13 is a figure which shows a relationship between the content of Ba in a spheroidizing agent and tensile strength.
Figure 14:
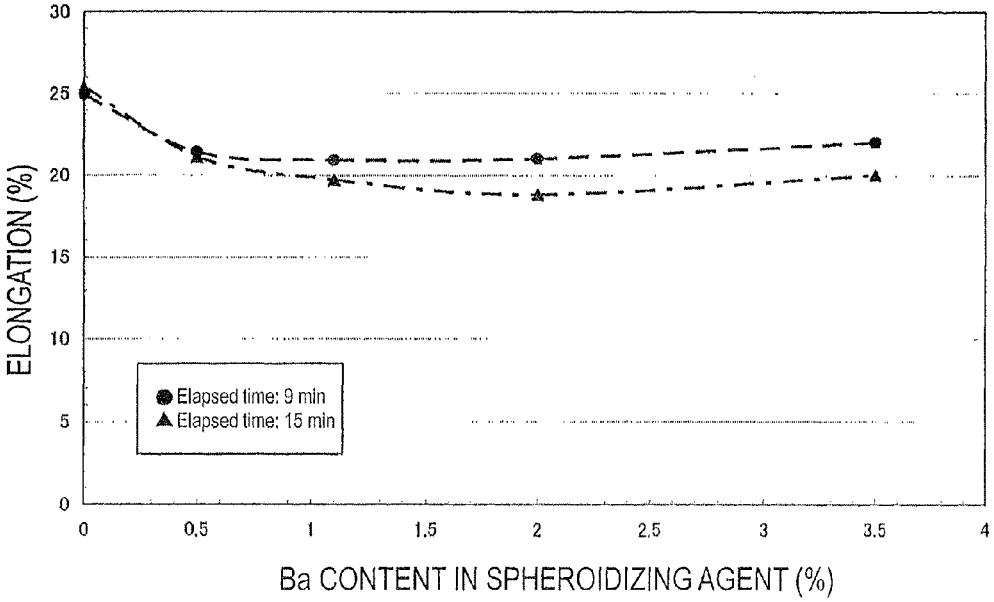
FIG. 14 is a figure which shows a relationship between the content of Ba in a spheroidizing agent and elongation.
Figure 15:
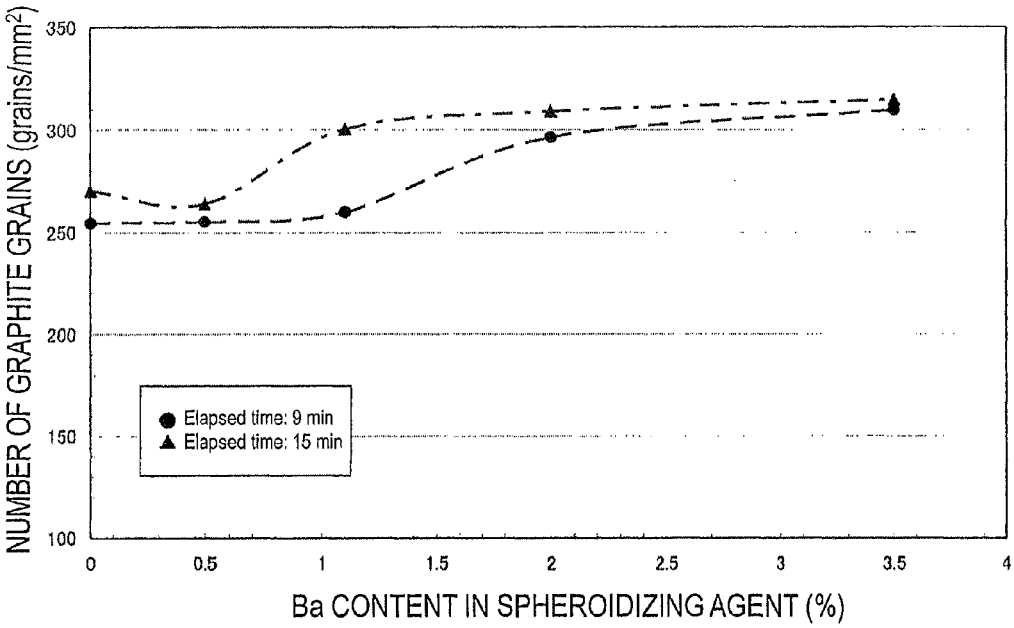
FIG. 15 is a figure which shows a relationship between the content of Ba in a spheroidizing agent and the number of graphite grains.

Similarly, FIGS. 7 to 10 respectively show relationships between the content of Ca, which is a basic component in a spheroidizing agent, and chill depth (FIG. 7), the degree of spheroidization (FIG. 8), tensile strength (FIG. 9), and elongation (FIG. 10). The differences in each property which were observed when the elapsed time from the spheroidization treatment to the casting was changed, i.e., from just after the treatment (after completion of the reaction) to 9 minutes and to 15 minutes, are also shown.

It was confirmed that when the content of Ca in the spheroidizing agent was about 2%, the chill depth was most satisfactory and that the tensile strength and the elongation tended to gradually improve as the content of Ca increased. It was also confirmed that the degree of spheroidization improved as the content of Ca increased to about 1.3%, but tended to decrease in the range where the content thereof is more than this, and improved again in the case where the content of Ca exceeded 2%.

Figure 16:
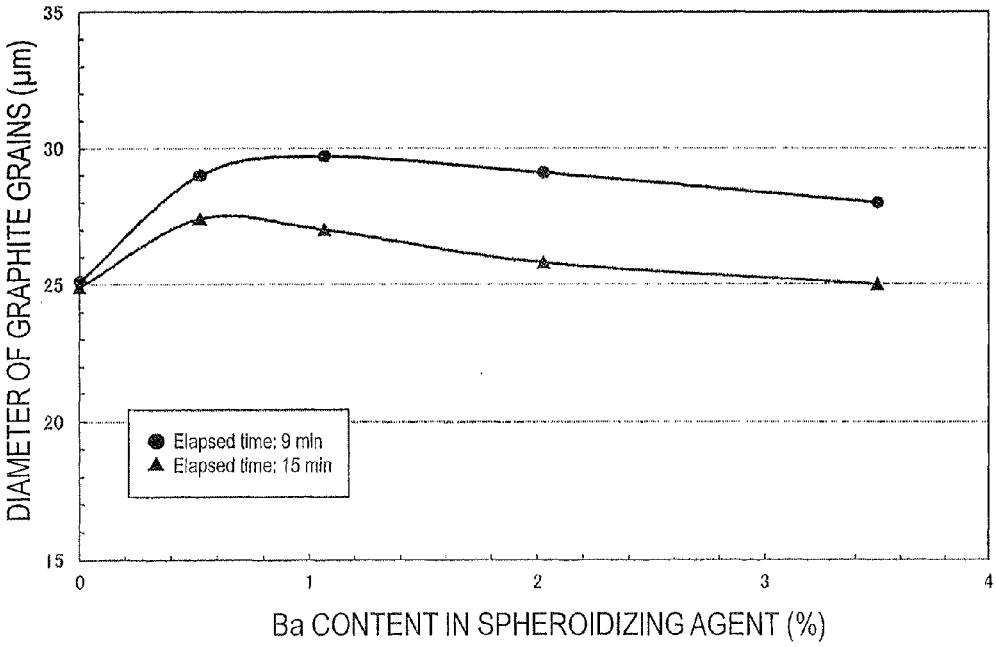
FIG. 16 is a figure which shows a relationship between the content of Ba in a spheroidizing agent and the diameter of graphite grains.

FIGS. 11 to 16 respectively show relationships between the content of Ba in a spheroidizing agent and chill depth (FIG. 11), the degree of spheroidization (FIG. 12), tensile strength (FIG. 13), elongation (FIG. 14), the number of graphite grains (FIG. 15), and the diameter of graphite grains (FIG. 16). The differences in each property which were observed when the elapsed time from the spheroidization treatment to the casting was changed, i.e., from just after the treatment (after completion of the reaction) to 9 minutes and to 15 minutes, are also shown.

As a result, in the range where the content of B is 0 to 0.5%, each of the chill depth, degree of spheroidization, tensile strength, and elongation tended to be slightly deteriorated by the addition of Ba. On the other hand, in the range of 0.5 to 3.5%, it was confirmed that the tendency to deterioration had become gone and the properties changed little or tended to improve slightly.

On the other hand, with respect to the number of graphite grains and diameter of graphite grains, which affect inhibition of the formation of internal defects such as shrinkage cavities, it was confirmed that the number of graphite grains tended to increase when the Ba content was in the range of 0.5 to 3.5%, and that the diameter of graphite grains tended to increase as the Ba content increased to about 0.8% but to decrease in the range where the content thereof is more than this.

Figure 17:
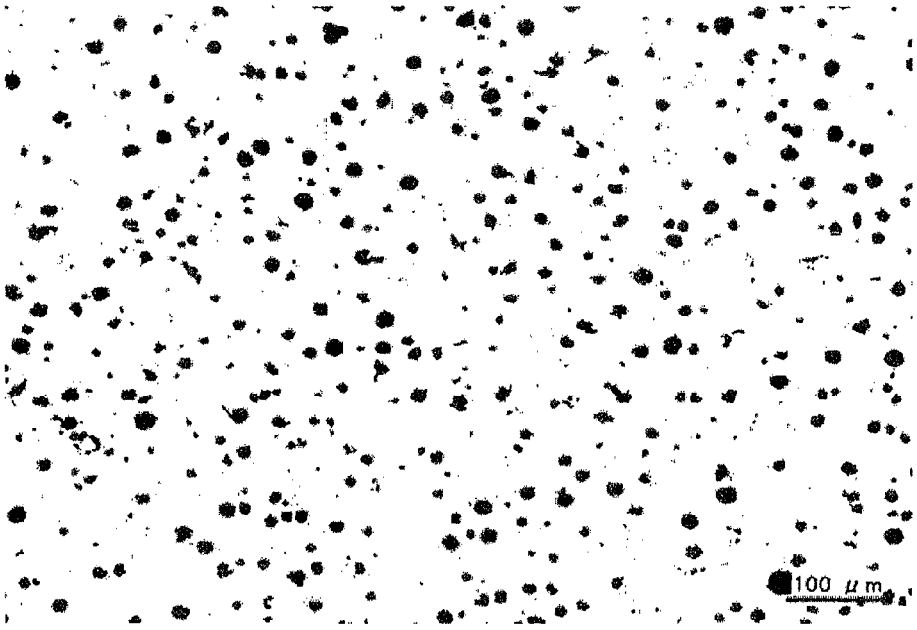
FIG. 17 is a photomicrograph which shows the microstructure of spheroidal graphite cast iron obtained using a spheroidizing agent not containing Ba.
Figure 18:
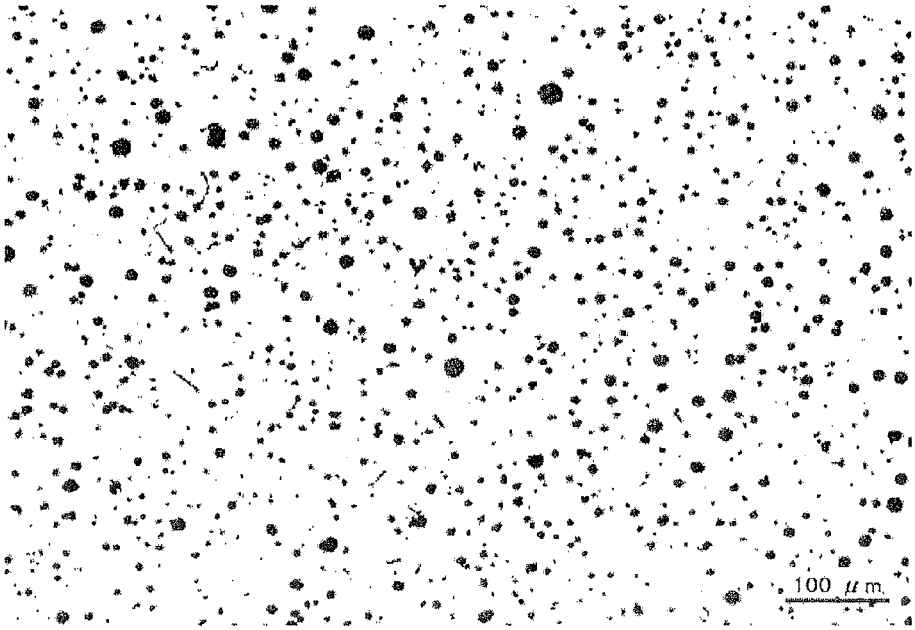
FIG. 18 is a photomicrograph which shows the microstructure of spheroidal graphite cast iron obtained using a spheroidizing agent containing Ba.

Furthermore, from the comparison between the microstructure shown in FIG. 17, which was obtained in the case of not adding Ba, and the microstructure shown in FIG. 18, which was obtained in the case of adding 2% of Ba, it was confirmed that the number of graphite grains had increased and the diameter of graphite grains had decreased, due to the addition of Ba to the spheroidizing agent.

As described above, Ba is frequently added to an inoculant for inoculation to be conducted after a spheroidization treatment. In also this preliminary test, a test in which Ba was added to a pouring inoculant was performed. The relationships between the content of Ba and various properties are shown together with the differences in each of the various properties which were observed when the elapsed time from the spheroidization treatment to the casting was changed to 9 minutes and to 15 minutes.

Figure 19:
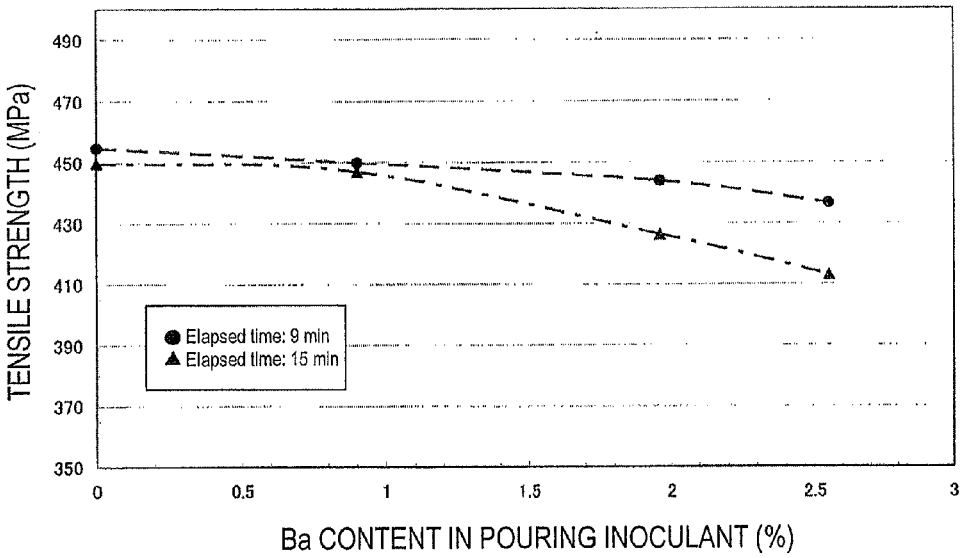
FIG. 19 is a figure which shows a relationship between the content of Ba in a pouring inoculant and tensile strength.
Figure 20:
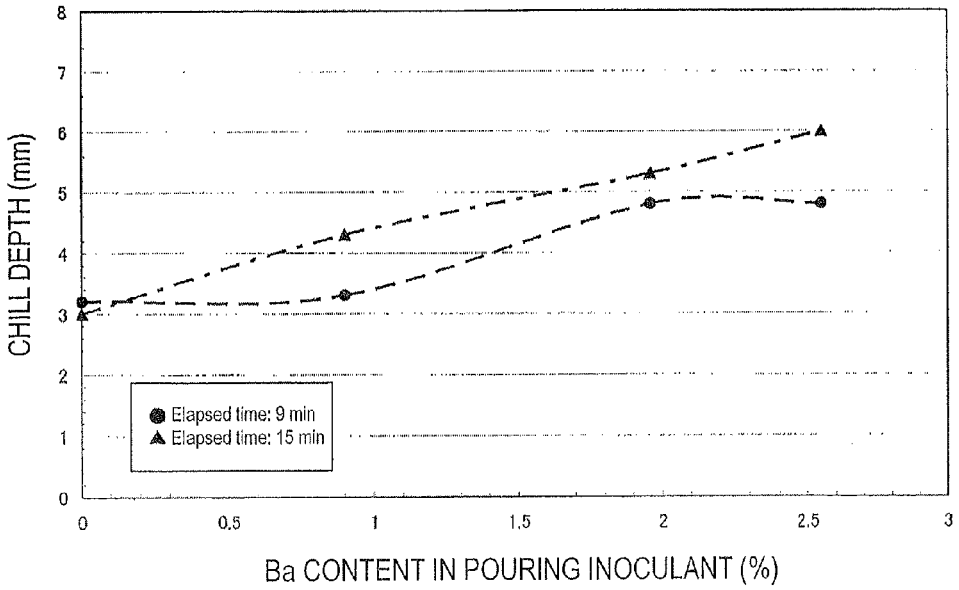
FIG. 20 is a figure which shows a relationship between the content of Ba in a pouring inoculant and chill depth.
Figure 21:
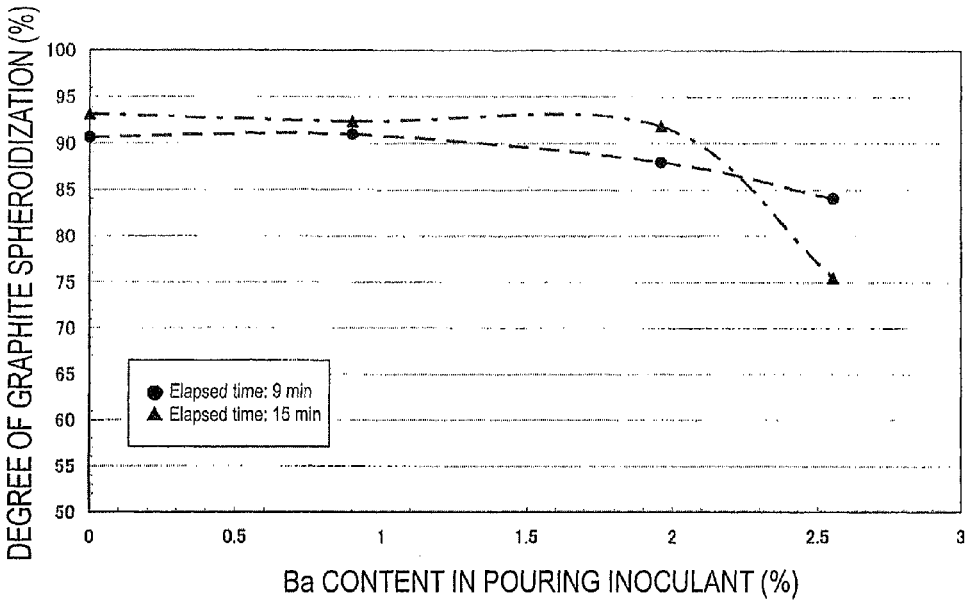
FIG. 21 is a figure which shows a relationship between the content of Ba in a pouring inoculant and the degree of spheroidization.
Figure 22:
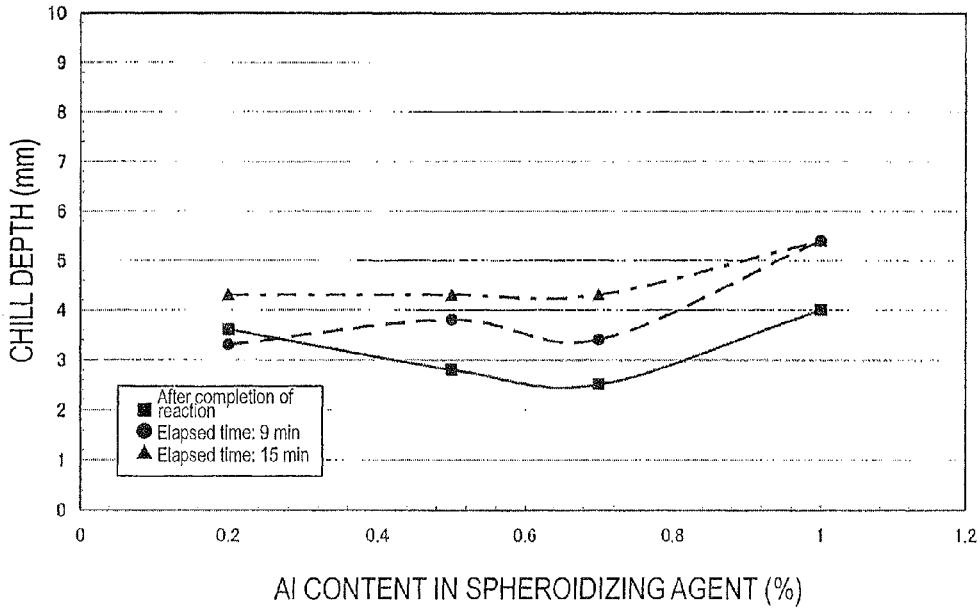
FIG. 22 is a figure which shows a relationship between the content of Al in a spheroidizing agent and chill depth.
Figure 23:
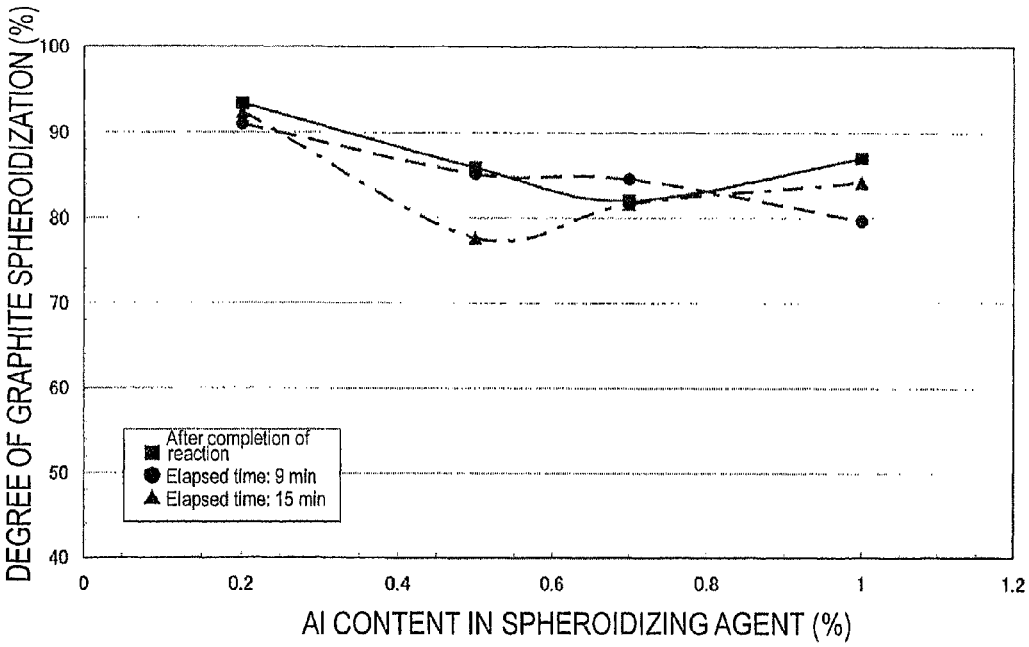
FIG. 23 is a figure which shows a relationship between the content of Al in a spheroidizing agent and the degree of spheroidization.
Figure 24:
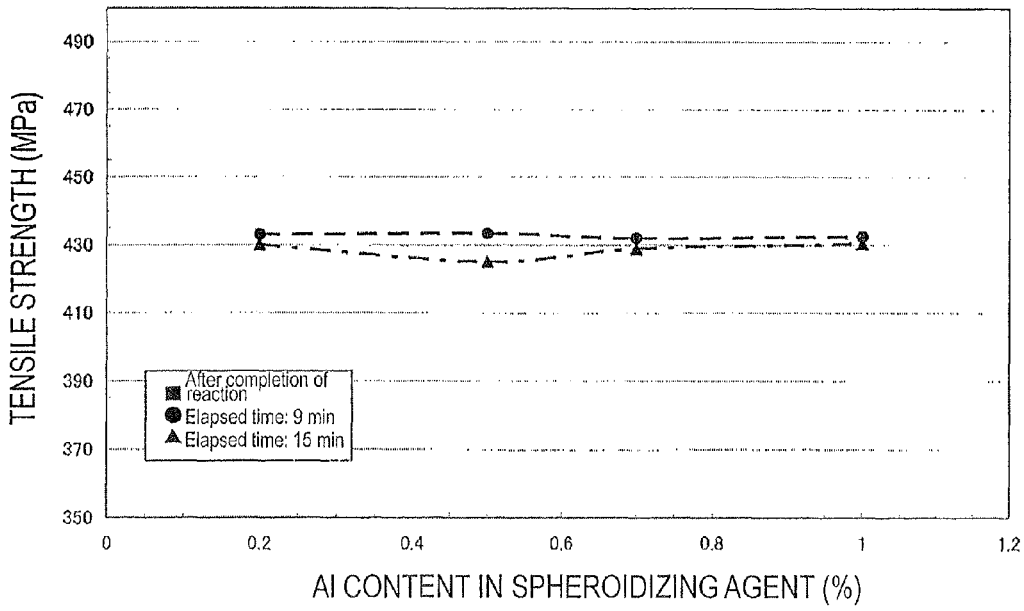
FIG. 24 is a figure which shows a relationship between the content of Al in a spheroidizing agent and tensile strength.

As shown in FIGS. 19 to 21, there was a tendency that the tensile strength (FIG. 19), chill depth (FIG. 20), and the degree of spheroidization (FIG. 21), each decreased as the content of Ba increased. It was confirmed that each of these properties tended to be lower when the elapsed time from the spheroidization treatment was longer (15 minutes).

It is hence understood that the addition of Ba to the inoculant is effective in accelerating graphitization and reducing graphite size but undesirably deteriorates the other properties.

Figure 25:
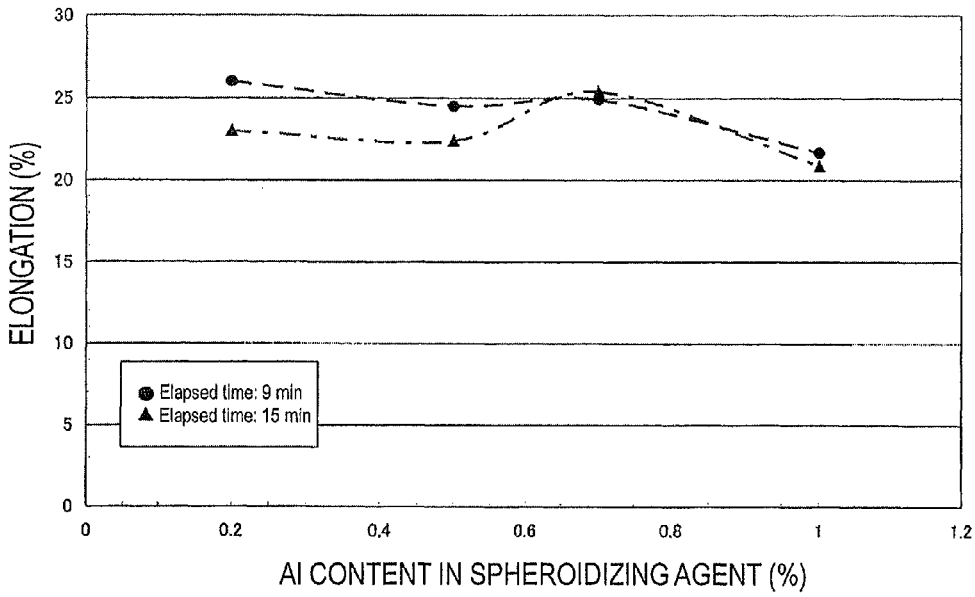
FIG. 25 is a figure which shows a relationship between the content of Al in a spheroidizing agent and elongation.
Figure 26:
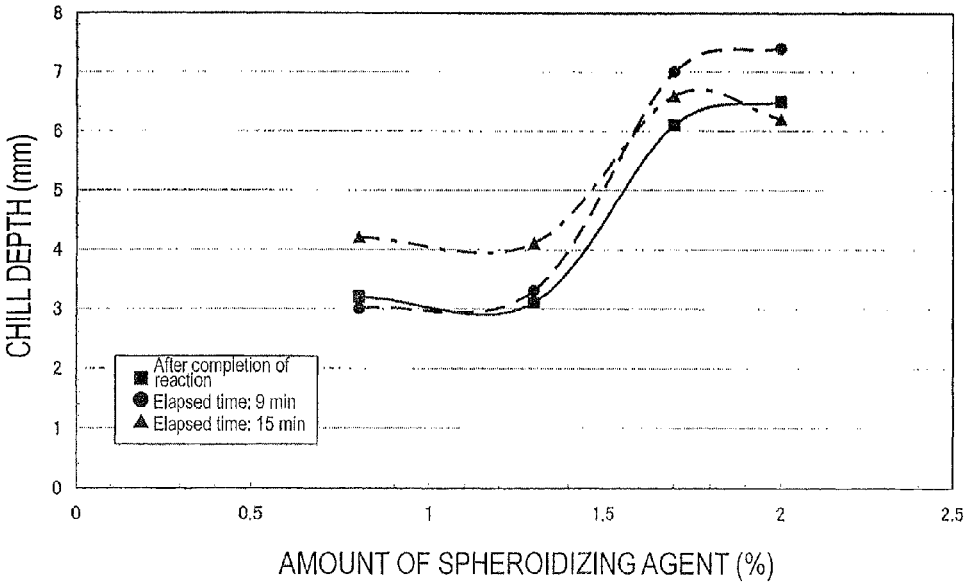
FIG. 26 is a figure which shows a relationship between the addition amount of a spheroidizing agent and chill depth.
Figure 27:
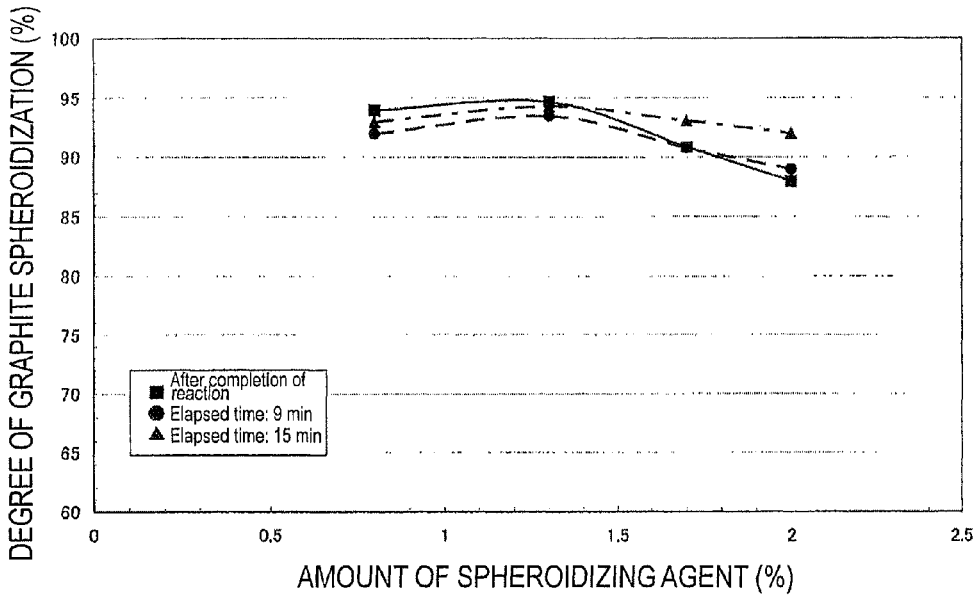
FIG. 27 is a figure which shows a relationship between the addition amount of a spheroidizing agent and the degree of spheroidization.
Figure 28:
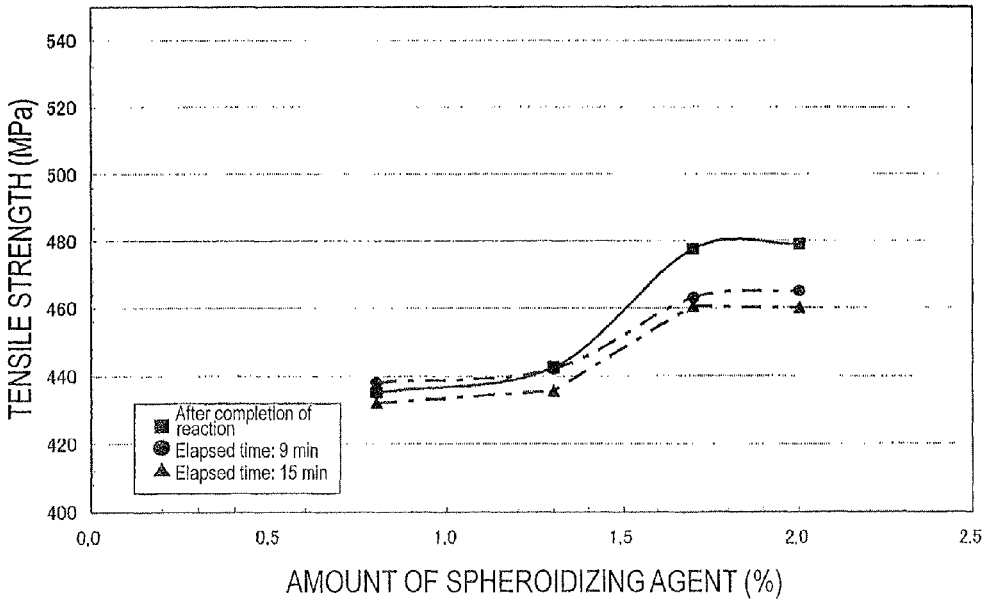
FIG. 28 is a figure which shows a relationship between the addition amount of a spheroidizing agent and tensile strength.

FIGS. 22 to 25 respectively show relationships between the content of Al in a spheroidizing agent and chill depth (FIG. 22), the degree of spheroidization (FIG. 23), tensile strength (FIG. 24), and elongation (FIG. 25). The differences in each property which were observed when the elapsed time from the spheroidization treatment to the casting was changed, i.e., from just after the treatment (after completion of the reaction) to 9 minutes and to 15 minutes, are also shown.

As a result, each of the properties did not show a large change when the content of Al was in the range of 0.2 to 1.0%. However, with respect to the chill depth, the degree of spheroidization, and the tensile strength, it was confirmed that the lower the content of Al was, the better the properties were.

[Addition Amount of Spheroidizing Agent]

Figure 29:
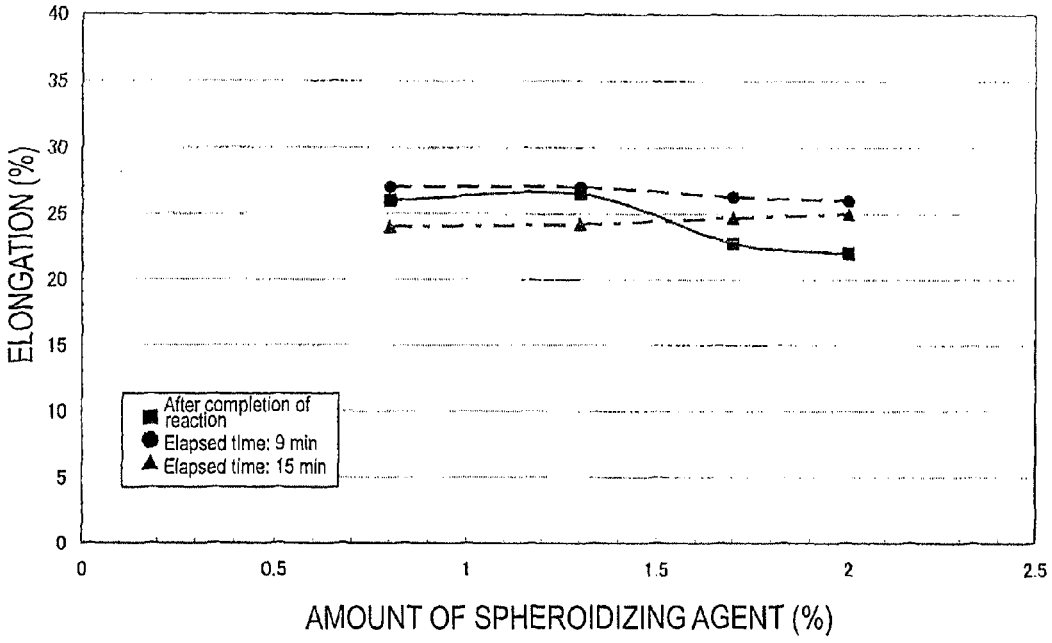
FIG. 29 is a figure which shows a relationship between the addition amount of a spheroidizing agent and elongation.

FIGS. 26 to 29 show relationships between the addition amount of a spheroidizing agent (0.8 to 2.0% by mass based on the molten iron), which is within the range according to the present invention, and chill depth (FIG. 26), the degree of spheroidization (FIG. 27), tensile strength (FIG. 28), and elongation (FIG. 29). The spheroidizing agent used here had the same composition as the spheroidizing agent shown as spheroidizing agent No. 1 in Table 2 which will be given later.

As a result, it was confirmed that in the case where the addition amount of the spheroidizing agent was in the range of 0.8 to 2.0% by mass based on the molten iron, the degree of spheroidization and the elongation changed little even when the addition amount increased, but the tendency to chill phase formation and the tensile strength increased as the addition amount increased. It is therefore necessary that the amount of the spheroidizing agent to be added should be comprehensively determined while taking account of such changes of each property.

From the results of the preliminary test described above, it was understood that for obtaining an as-cast material retaining a high level of properties other than internal defects using a spheroidizing agent containing no rare earth, it is necessary to simultaneously and accurately control the contents of Ba, Mg, Ca, and Al in the spheroidizing agent and the addition amount thereof Next, the present inventors produced automotive brake calipers as the spheroidal graphite cast iron member including the spheroidal graphite cast iron according to the present invention, using the same apparatus as in a mass-production line under production conditions that were set while taking account of the results of the preliminary test, and a confirmatory test with respect to actual products was conducted.

As a result, it was found that products which, even in the as-cast state, show excellent properties are obtained even in the case of using a spheroidizing agent containing no rare earth, by accurately controlling the melt components, the amounts of the basic components of an inoculant, and the addition amount thereof and by adding a given amount of Ba to the spheroidizing agent and then regulating the contents of Mg, Ca, and Al therein so as to be in given ranges.

Those properties are as follows: the product (member) has no internal defects, e.g., shrinkage cavities, and has excellent profitability; the tensile strength according to JIS Z 2241 is 450 MPa or higher, the elongation according to JIS Z 2241 is 15% or higher, the degree of spheroidization according to JIS G 5502 is 85% or higher, the Young's modulus according to JIS Z 2280 is 170 GPa or higher, and the logarithmic decrement according to JIS G 0602 is $1.0\times10^{-3}$ or higher; and this member, which includes the spheroidal graphite cast iron according to the present invention, has no chill phase in the thin-wall part thereof in which a thickness thereof is 6 mm or less.

The present inventors have thus found that a spheroidal graphite cast iron member, e.g., a component for vehicles, in which internal defects have been more strictly inhibited from being formed than in conventional products, can be produced by using cast iron produced by the production process according to the present invention. The present invention has been thus completed.

The process for producing spheroidal graphite cast iron according to the present invention and the spheroidal graphite cast iron member using the spheroidal graphite cast iron are explained below.

As raw materials to be melted to give the molten iron for use in the present invention, scraps of hot-rolled or cold-rolled steel, pig iron, returned materials, etc can be used. However, it is preferred to use materials in which the content of impurities such as O, S and P is low. It is, however, noted that even in the case where the content of these impurities is high, this raw material can be satisfactorily used by reducing the impurity content by conducting a desulfurization treatment or a flux treatment.

The melting furnace is not particularly limited. However, it is preferred to use an electric furnace, in particular, a high-frequency induction furnace. After the raw materials have been melted, C, Si, Mn, S, Cu, and Sn are suitably added thereto to regulate the components of the molten iron. Slag removal from the melting furnace before tapping and from the ladle after a spheroidization treatment is important from the standpoint of removing the slag, e.g., inclusions, which floats on the molten iron surface. It is desirable to conduct the slag removal without fail.

It is preferred that the composition of the molten iron should be regulated so as to contain, in terms of % by mass, 3.0 to 4.5% of C, 2.0 to 3.0% of Si, 0.2 to 0.4% of Mn, 0.006 to 0.020% of S, 0.03% or less of Al, 0.08 to 0.30% of Cu, 0.020 to 0.040% of Sn, and 0.01% or less of Zn, with the remainder being Fe and unavoidable impurities, from the standpoint of easily regulating the composition of the molten iron so that the spheroidal graphite cast iron to be obtained has a preferred composition. It is preferred that the molten iron temperature during melting and during component regulation should be regulated to 1,480 to 1,580° C.

Thereafter, the melting furnace is inclined and the molten iron is poured into a ladle. In this operation, a spheroidizing agent, a first inoculant, and a covering material are used to conduct a graphite spheroidization treatment and a primary inoculation treatment.

As a method for the spheroidization treatment, a sandwich method or another known means can be used. However, a sandwich method is usually employed from the standpoints of the concentration of Mg in the spheroidizing agent and the yield of Mg and the standpoints that the method does not necessitate any special equipment and is capable of stable graphite spheroidization.

As the spheroidizing agent, in view of the results of the preliminary test described above, an Mg-based spheroidizing agent such as an Fe—Si—Mg—Ca-based alloy which contains Ba can be used, and it is preferred to use a spheroidizing agent which contains, in terms of % by mass, 3.0 to 6.0% of Mg, 1.0 to 2.0% of Ca, 0.5 to 3.5% of Ba, and 0.3% or less of Al.

The elements which constitute the spheroidizing agent are described below in detail.

Mg is an element which is added in order to spheroidize the graphite, and remains in the molten iron after the spheroidization treatment. The content of Mg is necessary to be regulated to 3.0 to 6.0% in terms of % by mass based on the spheroidizing agent.

In the case where the content thereof is less than 3.0%, spheroidization of the graphite does not proceed sufficiently and, hence, the desired strength and rigidity are not obtained. On the other hand, since Mg is an element which is highly susceptible to oxidation, in the case where the content of Mg exceeds 6.0%, the amount of shrinkage cavities and content of Mg oxide in the matrix tends to be increased to thereby reduce the strength. Furthermore, as described above, a chill phase is prone to be formed, resulting in impaired machinability.

Ca is generally added in order to inhibit the Mg from reacting. However, Ca has the function of enhancing the tendency to chill phase formation, as shown in the preliminary test. The content of Ca in the spheroidizing agent is necessary to be regulated to 1.0 to 2.0% in terms of % by mass.

In the case where the content thereof is less than 1.0%, the effect of the addition thereof is not sufficiently expected. In the case where the content thereof exceeds 2.0%, the tendency to chill phase formation is enhanced and a chill phase is formed, resulting in an increase in slag.

In the present invention, Ba is added mainly for the purpose of inhibiting the formation of shrinkage cavities. The mechanism in which the formation of internal defects, such as shrinkage cavities, is inhibited by the addition of Ba is thought to be as follows.

Addition of Ba to the spheroidizing agent results in the formation of nuclei constituted of oxides of Ba. Consequently, the formation of graphite nuclei in the molten iron is accelerated and the frequency of the formation thereof increases, thereby enabling the graphitization reaction to be completed in a relatively short time as compared with the case where Ba is not contained. As a result, the amount of graphite formation in the final stage of solidification, during which shrinkage cavities and the like are formed, is reduced and the deformation of the casting mold due to volume expansion is considerably inhibited. It is thought that since the factors contributing to the formation of solidification defects (voids) are thus diminished, the formation of shrinkage cavities is inhibited.

It is preferred that the content of Ba in the spheroidizing agent should be regulated to 0.5 to 3.5% in terms of % by mass. So long as the content thereof is within this range, the decrease in tensile strength due to the acceleration of graphitization is not observed as shown in the preliminary test.

In the case where the content thereof is less than 0.5%, the effect of the addition thereof is not clearly observed and there is a possibility that internal defects such as shrinkage cavities might be formed depending on product shapes. In the case where the content thereof exceeds 3.5%, slag formation is enhanced and this not only results in the formation of internal defects to reduce the tensile strength and elongation but also results in a decrease in operation efficiency.

Al mainly has the effects of deoxidation and inhibition of chill phase formation. However, since Al is also a spheroidization-inhibitory element, inclusion thereof in an amount not less than a given value results in decreases in tensile strength or rigidity. Furthermore, there are cases where alumina, which is the oxide of aluminum, remains as an inclusion in the product to constitute casting defects. The results of the preliminary test described above also show that in the case where the content of Al in the spheroidizing agent was 0.3% or higher, no remarkable effect was observed on an improvement of each property. In view of these, the content of Al is regulated to 0.3% or less.

The amount of the spheroidizing agent to be added is necessary to be regulated to 0.8 to 2.0% in terms of % by mass based on the molten iron. In the case where the amount thereof is less than 0.8%, a sufficient degree of spheroidization is not obtained. In the case where the amount thereof exceeds 2.0%, the tendency to chill phase formation is enhanced as indicated by the preliminary test and there also is a possibility that some of the spheroidizing agent might remain undissolved in the molten iron.

It is preferred that the particle diameter of the spheroidizing agent should be regulated to about 0.05 to 5 mm, from the standpoints of preventing incomplete dissolution and uniformly mixing with the molten iron.

In the case of using a sandwich method as a method for the spheroidization treatment, a covering material is placed on the spheroidizing agent and the inoculant in order to prevent the spheroidizing agent and the inoculant from coming into direct contact with the molten iron, from the standpoint of inhibiting reactions from occurring until the level of the molten iron reaches a given position within the ladle. As the covering material, an Fe—Si-based material is used.

As the inoculant to be used in the primary inoculation treatment in the ladle, an Fe—Si—Ca-based or Ca—Si-based inoculant can be used. Usually, however, a first Fe—Si—Ca-based inoculant in which the Si content is 45 to 75% is used.

It is preferred to regulate the particle diameter of the inoculant to about 0.05 to 5 mm, from the standpoints of incomplete dissolution and uniform mixing with the molten iron.

The inoculant to be used in the primary inoculation treatment is disposed in the pocket at the bottom of the ladle together with the spheroidizing agent. The spheroidization treatment and the primary inoculation treatment need not be conducted simultaneously. The inoculant may be introduced alone into the ladle after the spheroidization treatment. It is, however, preferred that the primary inoculation treatment should be conducted immediately after the spheroidization treatment without delay, from the standpoint of enabling the pouring inoculation, which is conducted just before casting into a casting mold, to sufficiently produce the inoculation effect.

In the present invention, pouring inoculation is conducted after the spheroidization treatment and first inoculation treatment and before the molten iron which has undergone the spheroidization treatment is cast into a casting mold. As a pouring inoculant, a second Fe—Si—Ca-based inoculant is used. Specifically, it is necessary to use the inoculant which contains the following components in terms of % by mass: 45 to 75% of Si and 1.0 to 3.0% of Ca.

Si is a main element in the pouring inoculant, and the content thereof is regulated to about 45 to 75%, which is a standard amount in the case of using ferrosilicon-based raw materials. In the case where the content thereof is less than 45%, slag is formed in a larger amount. In the case where the content thereof exceeds 75%, the solubility of the inoculant decreases.

Ca has the effects of inhibiting chill phase formation and improving the degree of spheroidization on the basis of the acceleration of matrix graphitization and the acceleration of graphite spheroidization. The content of Ca in the pouring inoculant is necessary to be regulated to 1.0 to 3.0%, and is preferably regulated to 1.2 to 2.2%.

In the case where the content thereof is less than 1.0%, the effects of the inoculation are not produced and size reduction of graphite and spheroidization of graphite do not proceed. In the case where the content thereof exceeds 3.0%, the content of CaO, which is hard, increases, resulting in slag formation and poor machinability.

The amount of the pouring inoculant to be added, in terms of % by mass based on the molten iron which has not undergone the spheroidization treatment, is necessary to be 0.2 to 0.4%, and is preferably 0.25 to 0.30%, from the standpoints of lessening the tendency to chill phase formation and improving the degree of spheroidization and elongation.

In the case where the addition amount thereof exceeds 0.4%, a larger proportion of the inoculant remains undissolved and slag formation is enhanced. In the case where the addition amount thereof is less than 0.2%, the inoculation does not produce sufficient effects. As a result, not only the desired property improvements cannot be expected but also the yield of the introduced material decreases.

Pouring inoculants usually contain Al in an amount of 0.5 to 4.0%. This Al has been added mainly for the purposes of inhibiting chill phase formation and improving the base structure. In the present invention, the Al exerts substantially no influence on each property so long as the content thereof is within that range. However, when the addition amount thereof exceeds that range, these are cases where the oxide is causative of internal defects such as pin-holes. It is therefore necessary to sufficiently consider the composition of the pouring inoculant so that the content of Al in the composition of the spheroidal graphite cast iron does not exceed 0.03%.

Although the pouring inoculation is conducted just before casting into a casting mold, it is preferred that the inoculant should be introduced at a constant rate and uniformly mixed with the molten iron without fail, by using an automatic supplying apparatus or the like. It is also possible to conduct the inoculation by an in-mold inoculation method in which the inoculant is disposed in the casting mold. In this case, however, it is necessary to sufficiently contrive the design of the mold, etc. so that the inoculant does not remain undissolved and is uniformly mixed with the molten iron.

In addition, since the pouring inoculation treatment as the final treatment exerts considerable influences, it is necessary that the introduced inoculant should uniformly mix with the molten iron without fail to produce the effects thereof, for satisfying all of the desired material properties. From this standpoint, it is preferred to regulate the particle diameter of the pouring inoculant to 0.05 to 5 mm.

The spheroidal graphite cast iron thus obtained is necessary to contain substantially no rare earth and have a composition which contains, in terms of % by mass, 3.0 to 4.5% of C, 3.0 to 4.0% of Si, 0.2 to 0.4% of Mn, 0.006 to 0.020% of S, 0.03% or less of Al, 0.08 to 0.30% of Cu, 0.020 to 0.040% of Sn, 0.015 to 0.050% of Mg, and 0.01% or less of Zn, with the remainder being Fe and unavoidable impurities. Here, the wording "contains substantially no rare earth" means that inclusion thereof as unavoidable impurities in an amount of 0.001% or less is permissible although intentional addition is not conducted.

The content of C in the cast iron is necessary to be regulated to 3.0 to 4.5%, and is preferably regulated to 3.2 to 4.2%. In the case where the content thereof is less than 3.0%, the spheroidal graphite cast iron has an insufficient graphite content and the tendency to chill phase formation is enhanced, and the molten iron has impaired flowability. In the case where the content thereof exceeds 4.5%, C is in excess and kish graphite is apt to be formed. Consequently, the cast iron material itself is brittle, and given strength cannot be obtained.

The content of Si in the cast iron is necessary to be regulated to 3.0 to 4.0%, and is preferably regulated to 3.2 to 4.0%. In the case where the content thereof is less than 3.0%, the molten iron for spheroidal graphite cast iron has impaired flowability, and a chill structure is formed in an increased amount and cementite is apt to precipitate in the base structure, making it impossible to obtain the desired elongation. In the case where the content thereof exceeds 4.0%, the material has impaired homogeneity and an increased silicoferrite content. This material has become brittle and has considerably reduced elongation.

Mn is an element which accelerates pearlite formation, and the influence thereof on strength is important. The content of Mn in the cast iron is necessary to be regulated to 0.2 to 0.4%, and is preferably regulated to 0.25 to 0.35%. In the case where the content thereof is less than 0.2%, the pearlite amount in the microstructure decreases and the ferrite amount increases. Consequently, given strength is not obtained. On the other hand, in the case where the content thereof exceeds 0.4%, the amount of structures such as cementite or pearlite in the matrix increases and this enhances chill phase formation to exert an adverse influence on machinability.

The content of S in the cast iron is necessary to be regulated to 0.006 to 0.020%, and is preferably regulated to 0.008 to 0.014%. In the case where the content thereof is less than 0.006%, the effects of the inoculation and spheroidization are lessened. On the other hand, in the case where the content thereof exceeds 0.020%, the sulfides is found with Mg or Ca to consume these elements, thereby reducing the degree of spheroidization and the effect of inoculation.

Cu and Sn, in one view, are pearlite-forming elements which are added for the purpose of strengthening the matrix to improve the tensile strength, but in another view, are elements which inhibit the spheroidization of graphite. Furthermore, the strength-improving effect of Cu is said to be about 1/10 that of Sn, and the price of Cu is about 1/10 that of Sn.

Consequently, from the standpoint of the effects of the addition on strength improvement, elongation reduction, reduction of the degree of spheroidization, and enhancement of chill phase formation and from the standpoint of profitability, the content of Cu in the cast iron is necessary to be regulated to 0.08 to 0.30%, and is preferably regulated to 0.10 to 0.20%. Similarly, the content of Sn in the cast iron is necessary to be regulated to 0.020 to 0.040%, and is preferably regulated to 0.025 to 0.035%.

Besides being added as a deoxidizer to the molten iron, Al is always contained in the spheroidizing agent and inoculants together with Si. Although having the effect of accelerating deoxidation and graphitization, Al is a spheroidization-inhibitory element on one hand and reduces the strength and the toughness in the case where the content thereof in the cast iron exceeds 0.03%. Furthermore, since alumina ($Al_2O_3$), which is the oxide, is exceedingly hard and is present as an inclusion in the spheroidal graphite, there are cases where the alumina is causative of internal defects such as hard spots. In such cases, the alumina is causative of the damage and wear of the cutting tool and, hence, considerably reduces the production efficiency.

Consequently, the content of Al in the composition of the cast iron is necessary to be regulated to 0.03% or less. From this standpoint, it is preferred that not only the content of Al during initial melting should be regulated as low as possible but also the concentration of Al in the spheroidizing agent and in the inoculants should be controlled so as to be low.

Zn is an adherent component of plated steel sheets or the like among scrap iron, and there are hence cases where Zn is incorporated as an impurity. In the case where the content thereof exceeds 0.01%, a decrease in the degree of spheroidization, which is causative of decreases in tensile strength and ductility and of casting defects such as pin-holes, is frequently occurred. Consequently, the content of Zn is necessary to be regulated to 0.01% or less.

Next, an explanation is given on the case where the spheroidal graphite cast iron obtained by the production process in the present invention is applied to a component for vehicles, such as a brake caliper. The spheroidal graphite cast iron obtained by the production process in the present invention can be applied regardless of the thickness or size of the product. In the following explanation, however, the case where the cast iron is applied to an automotive brake caliper having a thickness of about 3 to 40 mm on the supposition of use in general passenger cars or commercial cars is explained as an example. The strength levels required for automotive brake caliper components vary depending on uses thereof. However, the present invention is suitable especially for calipers as provided for in JIS FCD400-FCD500.

First, it is necessary that after the pouring inoculation treatment described above, the molten iron obtained should be cast into a casting mold (sand mold). It is preferred that the casting temperature in this operation should be 1,300 to 1,450° C. From the standpoint of avoiding the influence of fading effect, it is preferred that the period from the spheroidization treatment to the casting should be 15 minutes or less. It is more preferred that the period from the spheroidization treatment to the casting should be 12 minutes or less without delay.

After the casting, cooling is sufficiently conducted until the temperature thereof declines to or below the eutectoid transformation point. Thereafter, the mold is disassembled. The automotive brake caliper obtained by the present invention is intended to be used in such a manner that the gate and the riser are removed therefrom and the resultant cast iron is used as cast, without being subjected to a heat treatment or the like. In this case, however, it is necessary that the period from the casting to the mold disassembly should be kept constant from the standpoint of keeping the dimensional accuracy, structure, hardness, etc. constant.

Although it is necessary to thereafter conduct simple machining such as drilling and surface cutting, the presence of abnormal structures, in particular, a chill phase, in the microstructure considerably affects the cuttability during the machining. In addition, in the case where inclusions such as alumina are present in the surface to be cut, the inclusions serve as hard spots and are causative of the breakage of the cutting tool.

The matrix of the finally obtained spheroidal graphite cast iron member (automotive brake caliper) which includes the spheroidal graphite cast iron according to the present invention is a mixed structure constituted of pearlite and ferrite. The proportion of the pearlite in the matrix (excluding graphite portions) is generally 20 to 60% in terms of areal proportion. This brake caliper is characterized by having a tensile strength according to JIS Z 2241 of 450 MPa or higher, an elongation according to JIS Z 2241 of 15% or higher, a degree of spheroidization according to JIS G 5502 of 85% or higher, a Young's modulus according to JIS Z 2280 of 170 GPa or higher, and a logarithmic decrement according to JIS G 0602 of $1.0\times10^{-3}$ or higher. This caliper including the cast iron is further characterized in that neither a chill phase nor internal defects are present even in the thin-wall part thereof having a thickness of 6 mm or less.

The wording "a chill phase is not present" means that the areal proportion of a chill phase determined through an examination of the structure located near the surface layer is less than 1%. The wording "internal defects are not present" means that, in a macroscopic inspection of a cross-section of the thin-wall part, wherein a corner or the like is included as the thin-wall part, the cross-section has neither cavity defects, such as shrinkage cavities, that have a diameter or major-axis length of 1 mm or larger nor hole defects such as pin-holes or voids.

EXAMPLES

The present invention will be explained below in more detail by reference to Examples in which as-cast spheroidal graphite cast iron produced by the process according to the present invention was used to produce an automotive brake caliper. However, the present invention should not be construed as being limited to the following Examples.

For the spheroidal graphitized cast iron of the Examples (Examples 1 to 15 and Comparative Examples 1 to 14), a returned cast iron material and scrap iron mainly constituted of hot-rolled steel were used as raw materials for molten iron. The ratio of the returned material to the scrap iron in the raw materials was about 1:1 by mass. The raw materials were melted using a high-frequency melting furnace. Thereafter, C, Si, Mn, S, Cu, and Sn were suitably added thereto as additive elements to regulate the molten iron so that the molten iron had the components corresponding to FCD450, i.e., the molten iron had a composition containing, in terms of % by mass, 3.0 to 4.5% of C, 2.0 to 3.0% of Si, 0.2 to 0.4% of Mn, 0.006 to 0.020% of S, 0.08 to 0.30% of Cu, 0.020 to 0.040% of Sn, 0.03% or less of Al, and 0.01% or less of Zn, with the remainder being Fe and unavoidable impurities. Thereafter, the molten iron was tapped and introduced into a ladle while regulating the tapping temperature to 1,500 to 1,550° C.

Prior to the tapping, any of Fe—Si—Mg—Ca-based spheroidizing agents having various compositions (spheroidizing agents Nos. 1 to 11 and reference) was placed in the pocket at the bottom of the ladle in an amount of 1.3% based on the molten iron to be poured, and a commercial Fe—Si-based covering material was placed thereon in an amount of 0.45% based on the molten iron to be poured. Then, a spheroidization treatment was conducted by a sandwich method. Thereafter, skimming was conducted.

The molten iron which had undergone the treatment was introduced into a small ladle, during which a primary inoculation treatment was conducted by an in-ladle method. Thereafter, skimming was performed. As the primary inoculant, a first Fe—Si—Ca-based alloy in ordinary use was used. Furthermore, just before the molten iron which had undergone the primary inoculation treatment was cast into a sand mold, a pouring inoculation treatment with any of second Fe—Si—Ca-based inoculants having various compositions (pouring inoculants Nos. 12 to 16) was conducted by means of an automatic injection device. Thus, spheroidal graphitized cast iron (Examples 1 to 15 and Comparative Examples 1 to 14) was obtained.

Table 1 shows the composition of the spheroidal graphite cast iron of each of Examples 1 to 15 and Comparative Examples 1 to 14, which was obtained after the pouring inoculation, and the spheroidizing agent No. and pouring inoculant No. used therefor. Table 2 shows the composition and addition amount for each of the spheroidizing agent Nos. and pouring inoculant Nos. In Table 1 and Table 2, the proportion of the Fe and unavoidable impurities which constituted the remainder of the composition is omitted.

TABLE 1

| | C | Si | Mn | S | Cu | Sn | Mg | Al | Zn | Spheroidizing agent No. | (mass %) Pouring inoculant No. |
|---|---|---|---|---|---|---|---|---|---|---|---|
| Example 1 | 3.5 | 3.6 | 0.31 | 0.012 | 0.12 | 0.025 | 0.035 | 0.007 | 0.002 | 1 | 12 |
| Example 2 | 3.5 | 3.6 | 0.32 | 0.012 | 0.12 | 0.025 | 0.037 | 0.008 | 0.009 | 1 | 12 |
| Example 3 | 3.6 | 3.6 | 0.32 | 0.006 | 0.13 | 0.025 | 0.036 | 0.009 | 0.002 | 1 | 12 |
| Example 4 | 3.6 | 3.7 | 0.28 | 0.020 | 0.12 | 0.024 | 0.036 | 0.008 | 0.001 | 1 | 12 |
| Example 5 | 3.5 | 3.5 | 0.29 | 0.013 | 0.08 | 0.030 | 0.035 | 0.011 | 0.002 | 1 | 12 |
| Example 6 | 3.6 | 3.6 | 0.32 | 0.011 | 0.30 | 0.025 | 0.034 | 0.008 | 0.001 | 1 | 12 |
| Example 7 | 3.4 | 3.7 | 0.32 | 0.012 | 0.13 | 0.020 | 0.037 | 0.008 | 0.004 | 1 | 12 |
| Example 8 | 3.6 | 3.7 | 0.33 | 0.012 | 0.12 | 0.040 | 0.035 | 0.010 | 0.002 | 1 | 12 |
| Example 9 | 3.6 | 3.6 | 0.28 | 0.012 | 0.15 | 0.025 | 0.034 | 0.028 | 0.002 | 1 | 12 |
| Example 10 | 3.5 | 3.6 | 0.31 | 0.012 | 0.12 | 0.024 | 0.034 | 0.009 | 0.003 | 2 | 12 |
| Example 11 | 3.6 | 3.5 | 0.32 | 0.012 | 0.13 | 0.024 | 0.035 | 0.007 | 0.001 | 3 | 12 |
| Example 12 | 3.6 | 3.6 | 0.33 | 0.012 | 0.14 | 0.024 | 0.038 | 0.012 | 0.002 | 4 | 12 |
| Example 13 | 3.5 | 3.5 | 0.31 | 0.011 | 0.14 | 0.024 | 0.049 | 0.008 | 0.002 | 5 | 12 |
| Example 14 | 3.6 | 3.5 | 0.32 | 0.012 | 0.13 | 0.024 | 0.025 | 0.007 | 0.001 | 6 | 12 |
| Example 15 | 3.6 | 3.6 | 0.30 | 0.012 | 0.12 | 0.024 | 0.035 | 0.008 | 0.001 | 1 | 13 |
| Comparative Example 1 | 3.6 | 3.7 | 0.29 | 0.005 | 0.12 | 0.025 | 0.036 | 0.007 | 0.001 | 1 | 12 |
| Comparative Example 2 | 3.6 | 3.6 | 0.30 | 0.010 | 0.40 | 0.010 | 0.034 | 0.008 | 0.002 | 1 | 12 |
| Comparative Example 3 | 3.5 | 3.7 | 0.33 | 0.030 | 0.12 | 0.030 | 0.035 | 0.009 | 0.035 | 1 | 12 |
| Comparative Example 4 | 3.5 | 3.7 | 0.32 | 0.012 | 0.05 | 0.025 | 0.035 | 0.008 | 0.004 | 1 | 12 |
| Comparative Example 5 | 3.5 | 3.6 | 0.31 | 0.012 | 0.12 | 0.025 | 0.036 | 0.038 | 0.002 | 1 | 12 |
| Comparative Example 6 | 3.4 | 3.6 | 0.31 | 0.010 | 0.12 | 0.025 | 0.034 | 0.012 | 0.006 | 7 | 12 |
| Comparative Example 7 | 3.5 | 3.7 | 0.31 | 0.012 | 0.12 | 0.025 | 0.046 | 0.017 | 0.003 | 8 | 12 |
| Comparative Example 8 | 3.5 | 3.5 | 0.32 | 0.012 | 0.13 | 0.025 | 0.017 | 0.007 | 0.002 | 9 | 12 |
| Comparative Example 9 | 3.5 | 3.6 | 0.31 | 0.012 | 0.12 | 0.025 | 0.049 | 0.021 | 0.004 | 10 | 12 |
| Comparative Example 10 | 3.5 | 3.6 | 0.31 | 0.012 | 0.12 | 0.025 | 0.035 | 0.007 | 0.002 | 11 | 12 |
| Comparative Example 11 | 3.5 | 3.5 | 0.31 | 0.012 | 0.12 | 0.025 | 0.036 | 0.008 | 0.003 | 1 | 14 |
| Comparative Example 12 | 3.5 | 3.5 | 0.31 | 0.012 | 0.12 | 0.025 | 0.034 | 0.009 | 0.002 | 1 | 15 |
| Comparative Example 13 | 3.5 | 3.5 | 0.31 | 0.012 | 0.12 | 0.025 | 0.034 | 0.015 | 0.002 | 1 | 16 |
| Comparative Example 14 | 3.5 | 3.6 | 0.31 | 0.012 | 0.12 | 0.025 | 0.035 | 0.007 | 0.002 | reference | 12 |

TABLE 2

| | No. | Si (%) | Mg (%) | Ca (%) | Ba (%) | Al (%) | (mass %) Addition amount (%) |
|---|---|---|---|---|---|---|---|
| Spheroidizing agent | 1 | 46 | 4.80 | 1.50 | 2.01 | 0.23 | 1.50 |
| | 2 | 45 | 4.80 | 1.51 | 0.50 | 0.23 | 1.50 |
| | 3 | 45 | 4.80 | 1.51 | 3.49 | 0.23 | 1.50 |
| | 4 | 46 | 4.80 | 1.51 | 2.01 | 0.29 | 1.50 |
| | 5 | 45 | 5.95 | 1.51 | 2.01 | 0.23 | 2.00 |
| | 6 | 46 | 3.01 | 1.02 | 2.01 | 0.23 | 1.50 |
| | 7 | 46 | 4.80 | 1.51 | 0.35 | 0.23 | 1.50 |
| | 8 | 46 | 4.80 | 1.51 | 2.01 | 0.23 | 2.50 |
| | 9 | 45 | 4.80 | 3.00 | 2.01 | 0.23 | 0.45 |
| | 10 | 45 | 6.50 | 1.50 | 1.99 | 0.55 | 1.50 |
| | 11 | 44 | 4.81 | 1.51 | 3.80 | 0.24 | 1.50 |
| | reference | 45 | 4.80 | 1.55 | <0.001 | 0.62 | 1.50 |
| Pouring inoculant | 12 | 75 | | 1.51 | | 2.01 | 0.28 |
| | 13 | 75 | | 1.00 | | 2.10 | 0.39 |
| | 14 | 74 | | 4.02 | | 2.03 | 0.28 |
| | 15 | 75 | | 1.50 | | 2.02 | 0.15 |
| | 16 | 74 | | 1.95 | | 1.98 | 0.50 |

Each spheroidal graphitized cast iron obtained above was cast into a casting mold made of green sand and was then sufficiently cooled until the temperature thereof declined to or below the eutectoid transformation point, and the mold was disassembled.

In each of the Examples and Comparative Examples, the period from the spheroidization treatment to the casting was 12 minutes or less. Thereafter, ordinary finishing, such as shot blasting and gate, dam, and burr removal, was conducted. Thus, automotive brake calipers were produced (Examples 1 to 15 and Comparative Examples 1 to 14).

A tensile test specimen (overall length, 60 mm) was cut out of each automotive brake caliper obtained, and this specimen was subjected to a tensile test at ordinary temperature (according to JIS Z 2241) to evaluate the tensile strength and elongation. The brake caliper was further examined for rigidity (Young's modulus) (according to JIS Z 2280) and logarithmic decrement (according to JIS G 0602) by a free oscillation method in which a strip test specimen was used. Moreover, test specimens for examining metallographic structure were cut out from different portions of each product and examined for the degree of spheroidization and other properties (according to JIS G 5502). Furthermore, test specimens were cut out also from the thin-wall parts, which were prone to have undergone chill phase formation, and the structure near the surface layer was examined to determine the presence or absence of a chill phase. In addition, an appearance inspection, a macroscopic inspection of cross-sections, a PT inspection (according to JIS Z 2343), and the like were performed in order to evaluate each product for internal defects present therein, such as shrinkage cavities. With respect to chill phase, the case where the chill area rate exceeded 1% was rated as "present", and the case where the chill area rate was less than 1% was rated as "absent".

Internal defects were evaluated through the macroscopic inspection of cross-sections in the following manner. The case where neither shrinkage cavities (cavity defects) having a diameter of 1 mm or larger nor other defects, i.e., hole defects, e.g., pin-holes or voids, having a major-axis length of 1 mm or larger were observed at all is rated as "○". The case where one or more defects having a diameter or major-axis length of 1 mm or larger were observed and where the maximum defect had a size exceeding 2 mm in terms of diameter or major-axis length was rated as "x". The case where one or more defects having a diameter or major-axis length of 1 mm or larger were observed and where the maximum defect had a size in the range of 1 to 2 mm in terms of diameter or major-axis length is rated as "Δ" and this case is thereby distinguished from the case where larger defects were observed. The results of the evaluation are shown in Table 3.

TABLE 3

| | Tensile strength MPa | Elongation % | Young's modulus GPa | Degree of spheroidization % | Logarithmic decrement ($\times 10^{-3}$) | Presence or absence of chill phase | Presence or absence of internal defect |
|---|---|---|---|---|---|---|---|
| Example 1 | 514 | 18 | 176 | 92 | 1.3 | ○ | ○ |
| Example 2 | 535 | 18 | 188 | 90 | 1.3 | ○ | ○ |
| Example 3 | 520 | 16 | 180 | 93 | 1.4 | ○ | ○ |
| Example 4 | 522 | 19 | 178 | 86 | 1.5 | ○ | ○ |
| Example 5 | 528 | 16 | 176 | 91 | 1.4 | ○ | ○ |
| Example 6 | 515 | 17 | 178 | 87 | 1.4 | ○ | ○ |
| Example 7 | 512 | 18 | 181 | 94 | 1.3 | ○ | ○ |
| Example 8 | 541 | 16 | 180 | 89 | 1.6 | ○ | ○ |
| Example 9 | 520 | 17 | 181 | 88 | 1.3 | ○ | ○ |
| Example 10 | 520 | 22 | 183 | 92 | 1.3 | ○ | ○ |
| Example 11 | 522 | 18 | 182 | 89 | 1.5 | ○ | ○ |
| Example 12 | 516 | 20 | 178 | 91 | 1.3 | ○ | ○ |
| Example 13 | 511 | 19 | 183 | 92 | 1.3 | ○ | ○ |
| Example 14 | 518 | 18 | 179 | 88 | 1.6 | ○ | ○ |
| Example 15 | 524 | 19 | 182 | 93 | 1.3 | ○ | ○ |
| Comparative Example 1 | 425 | 8 | 161 | 82 | 0.9 | x | x |
| Comparative Example 2 | 418 | 7 | 151 | 74 | 0.8 | ○ | ○ |
| Comparative Example 3 | 412 | 6 | 158 | 69 | 1.3 | x | x |
| Comparative Example 4 | 415 | 13 | 172 | 81 | 0.9 | ○ | ○ |
| Comparative Example 5 | 423 | 14 | 154 | 65 | 1.3 | x | x |
| Comparative Example 6 | 452 | 12 | 165 | 75 | 1.1 | ○ | Δ |
| Comparative Example 7 | 449 | 7 | 155 | 81 | 0.9 | x | x |
| Comparative Example 8 | 423 | 6 | 171 | 82 | 1.2 | x | x |
| Comparative Example 9 | 426 | 11 | 178 | 84 | 0.9 | x | x |
| Comparative Example 10 | 455 | 7 | 173 | 80 | 1.2 | ○ | Δ |
| Comparative Example 11 | 410 | 9 | 161 | 73 | 0.8 | x | x |
| Comparative Example 12 | 435 | 8 | 162 | 75 | 1.2 | ○ | x |
| Comparative Example 13 | 440 | 12 | 167 | 80 | 1.1 | ○ | x |
| Comparative Example 14 | 465 | 14 | 172 | 78 | 1.3 | ○ | Δ |

○: absent;
x: present;
Δ: maximum defect size: 1 to 2 mm in terms of diameter or major-axis length The cases of Examples 1 to 9 differed in components during melting, the cases of Examples 10 to 14 differed in spheroidization conditions (components of the spheroidizing agent and addition amount thereof), and the case of Example 15 differed in pouring inoculation conditions (components of the pouring inoculant and addition amount thereof), respectively within the ranges according to the present invention.

Comparative Examples 1 to 5 are cases where at least one component is outside the range according to the composition of the cast iron specified in the present invention. Comparative Examples 6 to 10 are cases where the requirements for the spheroidizing agent are outside the range according to the present invention, and Comparative Examples 11 to 13 are cases where the requirements for the pouring inoculant are outside the range according to the present invention. Comparative Example 14 is an example of cases where a spheroidizing agent containing neither any rare earth nor Ba was used.

As shown in Table 3, the case of Example 1, which satisfied the requirements according to the present invention, and the case of Example 2, in which the Zn content had been changed within the range according to the present invention, gave values of tensile strength, elongation, rigidity, and logarithmic decrement which were not below the target values. With respect to internal defects, no defect larger than the target value of 1 mm in terms of diameter or major-axis length was observed, and the effect according to the present invention was confirmed.

The cases of Examples 3 and 4 differed in S content in the molten iron, the cases of Examples 5 and 6 differed in Cu content therein, the cases of Examples 7 and 8 differed in Sn content therein, and the case of Example 9 differed in Al content therein, respectively within the ranges according to the present invention. These Examples gave values of tensile strength, elongation, rigidity, and logarithmic decrement which were not below the target values, and had no chill phase in the thin-wall parts. In addition, internal defects of 1 mm or larger in terms of diameter or major-axis length had been formed therein. These objects as caliper components showed excellent properties.

The cases of Examples 10 to 14 differed in the content of Ba, Mg, or Al in the spheroidizing agent and in the addition amount thereof. It was confirmed that no internal defects of 1 mm or larger in terms of diameter or major-axis length had been formed in each Example and that the other properties also sufficiently reached the target values.

The case of Example 15 differed in Ca content in the pouring inoculant and in the addition amount thereof. It was confirmed that there were no internal defects of 1 mm or larger in terms of diameter or major-axis length therein and this object was satisfactory in terms of each of tensile strength, the degree of spheroidization, and tendency to chill phase formation and was not problematic as a caliper component.

In Examples 1 to 15, slag formation was sufficiently inhibited although Ba was added, by accurately regulating the contents of Mg, Al, and Ca in the spheroidizing agent. The amount of the slag formed was substantially the same as in the conventional process.

On the other hand, in Comparative Examples 1 to 5, at least one of the components of the molten iron was outside the range according to the present invention.

It was confirmed that in each Comparative Example, properties thereof such as the formation of internal defects or tensile strength did not reach the target values.

The case of Comparative Example 1 suffered chill phase formation because of the too low S content in the molten iron, and was insufficient in the degree of spheroidization and elongation. The case of Comparative Example 2 was considerably reduced in the degree of spheroidization and tensile strength because the amount of Cu added to the molten iron was too large. The case of Comparative Example 3 suffered the formation of internal defects and a chill phase and was reduced also in tensile strength and the degree of spheroidization, because the contents of S and Zn in the molten iron were too high. The case of Comparative Example 4 had a considerably reduced tensile strength because the amount of Cu added for strength improvement was too small. The case of Comparative Example 5 suffered the formation of internal defects and a decrease in the degree of spheroidization and was reduced also in tensile strength and Young's modulus, because of the too high Al content.

In Comparative Examples 6 and 10, the Ba content of the spheroidizing agents are outside the range according to the present invention. In Comparative Example 6, graphitization did not proceed and the amount of shrinkage during solidification increased, because of the too low content of Ba in the spheroidizing agent. Internal defects, e.g., shrinkage cavities, which had a maximum size of about 1 to 2 mm in terms of diameter or major-axis length had formed therein although the amount thereof was slight, resulting in decreases in elongation and Young's modulus. The case of Comparative Example 10 similarly suffered the formation of internal defects having a maximum size of about 1 to 2 mm in terms of diameter or major-axis length because of the too high content of Ba in the spheroidizing agent, although the amount thereof was slight, resulting in decrease in tensile strength and elongation.

The case of Comparative Example 7 suffered the formation of internal defects and a chill phase and was reduced also in elongation and Young's modulus, because of the too large addition amount of the spheroidizing agent.

In Comparative Examples 8 and 9, at least one of the Ca content, Mg content, and Al content in the spheroidizing agent is outside the range according to the present invention. In both Comparative Examples, the increase in slag formation amount due to the addition of Ba was unable to be inhibited and, hence, not only internal defects were formed but also the tendency to chill phase formation was enhanced and the elongation decreased.

In Comparative Examples 11 to 13, the Ca content in the pouring inoculant or the addition amount thereof is outside the range according to the present invention. The case of Comparative Example 11 suffered the formation of internal defects and a chill phase and was reduced also in tensile elongation and decrement, because of the too high Ca content in the pouring inoculant. The case of Comparative Example 12 suffered the formation of internal defects and a chill phase and was reduced in the degree of spheroidization and tensile elongation, because of the too small addition amount of the pouring inoculant. The case of Comparative Example 13 suffered the formation of internal defects because of the too large amount of the pouring inoculant, and the strength and Young's modulus thereof did not reach the target values.

In Comparative Example 14, the melt components and the inoculation conditions have been regulated so as to be within the ranges according to the present invention but Ba has not been added to the spheroidizing agent. Because of this, it was confirmed that internal defects of 1 mm or larger but smaller than 2 mm in terms of diameter or major-axis length had been formed in several areas, although no internal defect of 2 mm or larger in terms of diameter or major-axis length was observed. The properties other than internal defects substantially reached the target values.

As described above, in the case where the requirements specified in the present invention were not satisfied, any of the properties did not reach the target value.

While the present invention has been described in detail and with reference to specific embodiments thereof, it will be apparent to one skilled in the art that various changes and modifications can be made therein without departing from the spirit and scope thereof.

This application is based on Japanese patent application No. 2011-282407 filed on Dec. 22, 2011, the contents of which are incorporated herein by reference.

The invention claimed is:

1. A process for producing spheroidal graphite cast iron which contains substantially no rare-earth element, the process comprising:

(a) a step of adding a spheroidizing agent of an Fe—Si—Mg—Ca-based alloy to a molten iron in an amount of 0.8 to 2.0%, in terms of % by mass based on the molten iron, to conduct a spheroidization treatment of the molten iron in a ladle, the spheroidizing agent containing in terms of % by mass, 3.0 to 6.0% of Mg, 1.0 to 2.0% of Ca, 0.5 to 3.5% of Ba, and 0.3% or less of Al and that contains substantially no rare-earth element;

(b) a step of conducting an inoculation treatment using a first Fe—Si—Ca-based inoculant or Ca—Si-based inoculant, either simultaneously with the step (a) or after the step (a); and (c) a step of adding a second Fe—Si—Ca-based inoculant containing, in terms of % by mass, 45 to 75% of Si and 1.0 to 3.0% of Ca to the molten iron after the step (b) and before the molten iron is cast into a casting mold, in an amount of 0.2 to 0.4% in terms of % by mass based on the molten iron which has not undergone the spheroidization treatment, to conduct a pouring inoculation treatment, wherein the spheroidal graphite cast iron to be obtained has a composition which contains, in terms of % by mass, 3.0 to 4.5% of C, 3.0 to 4.0% of Si, 0.2 to 0.4% of Mn, 0.006 to 0.020% of S, 0.08 to 0.30% of Cu, 0.020 to 0.040% of Sn, 0.015 to 0.050% of Mg, 0.03% or less of Al, and 0.01% or less of Zn, with the remainder being Fe and unavoidable impurities.

2. A spheroidal graphite cast iron member comprising spheroidal graphite cast iron obtained by the production process according to claim 1, the spheroidal graphite cast iron member having a degree of graphite spheroidization of 85% or higher, a tensile strength of 450 MPa or higher, an elongation of 15% or higher, a Young's modulus of 170 GPa or higher, and a logarithmic decrement of $1.0\times10^{-3}$ or higher, wherein a chill area rate is 1% or less in a thin-wall part in which the spheroidal graphite cast iron member comprising the spheroidal graphite cast iron has a thickness of 6 mm or less, wherein, in a macroscopic inspection of a cross-section of the thin-wall part, the cross-section has none of a shrinkage cavity, a pin-hole and a void, each having a diameter or major-axis length of 1 mm or larger.

* * * * *